US005506667A

United States Patent [19]

Kinoshita

[11] Patent Number: 5,506,667

[45] Date of Patent: Apr. 9, 1996

[54] THERMAL IMAGE-FIXING APPARATUS WITH A VARIABLE RESISTANCE HEATER ROLLER

[75] Inventor: Naohisa Kinoshita, Nagoya, Japan

[73] Assignee: Brother Kogyo Kabushiki Kaisha, Nagoya, Japan

[21] Appl. No.: 328,506

[22] Filed: Oct. 25, 1994

[30] Foreign Application Priority Data

Oct. 29, 1993 [JP] Japan ..... 5-294261

[51] Int. Cl.[6] ..... G03G 15/20

[52] U.S. Cl. ..... 355/290; 355/285

[58] Field of Search ..... 355/203, 204, 355/208, 282, 285, 289, 290, 295; 219/216

[56] References Cited

U.S. PATENT DOCUMENTS

| | | | |
|---|---|---|---|
| 4,471,210 | 9/1984 | Van Den Eijnden | 219/216 |
| 5,045,887 | 9/1991 | Nakamura | 355/282 |
| 5,138,379 | 8/1992 | Kanazashi | 355/208 |
| 5,149,941 | 9/1992 | Hirabayashi et al. | 219/216 |
| 5,276,482 | 1/1994 | Nakanishi | 355/208 |
| 5,283,621 | 2/1994 | Hashizume | 355/290 |
| 5,361,124 | 11/1994 | Rowe et al. | 355/208 |
| 5,402,211 | 3/1995 | Yoshikawa | 355/285 |
| 5,412,453 | 5/1995 | Matsuo | 355/208 |

*Primary Examiner*—Sandra L. Brase
*Attorney, Agent, or Firm*—Oliff & Berridge

[57] ABSTRACT

An image-fixing apparatus including a presser roller; a heater roller held in contact with the presser roller to provide a nipper for nipping a recording sheet bearing an unfixed image thereon, an electric resistance of the heater roller decreasing as respective contact areas of the heater and presser rollers which areas define the nipper increase; a supplying device which supplies an electricity to the heater roller so that the nipper generates a thermal energy to thermally fix the unfixed image on the recording sheet; a measuring device which measures the electricity supplied from the supplying device to the heater roller; and a sheet-jamming detecting device which detects a jamming of the recording sheet at the nipper, based on the electricity measured by the measuring device.

31 Claims, 13 Drawing Sheets

THERMAL IMAGE-FIXING APPARATUS WITH A VARIABLE RESISTANCE HEATER ROLLER

BACKGROUND OF THE INVENTION

1. Field of the Invention

The present invention relates to a thermal image-fixing apparatus which thermally fixes an unfixed image such as a toner image on a recording sheet.

2. Related Art Statement

There is known a thermal image-fixing device which thermally fixes an unfixed toner image on a recording sheet in a printer or copier of an electrophotographic type. The image-fixing device includes a heater roller and a halogen lamp. The heater roller is provided by a hollow cylindrical roller formed of a heat-conductive material such as aluminum or stainless steel. The heater roller is rotatable around the halogen lamp fixed in the hollow space of the roller, so that the heater roller receives, from the halogen lamp, an amount of thermal energy necessary to fix the toner image on the recording sheet. The image-fixing device further includes a presser roller formed of, e.g., a heat-resistant silicone rubber. The presser roller cooperates with the heater roller to provide a nipper for nipping, with a suitable pressing force, the recording sheet to which the toner image has been transferred.

The prior image-fixing device further includes a temperature sensor located adjacent the heater roller, and a control device which adjusts, based on the temperature detected by the sensor, an amount of electricity supplied to the halogen lamp and thereby controls the amount of heat generated by the halogen lamp, so that the surface temperature of the halogen lamp is maintained at suitable values. The image-fixing device further includes a thermal fuse located adjacent the heater roller. In the event that the amount of heat generated from the halogen lamp is not controllable because of the occurrence of some trouble with the image-fixing device, the thermal fuse shuts off the supplying of electricity to the lamp, thereby preventing a fire or other safety hazards.

In the prior image-fixing device, however, the halogen lamp heats (a) other portions of the heater roller than a portion thereof corresponding to the nipper where the heater roller contacts the recording sheet and the toner image thereon; (b) bearings which rotatably support the heater roller; and (c) ambient air around the halogen lamp. Thus, the image-fixing device suffers from the following problems:

First, the bearings and other elements for supporting the heater roller, presser roller, temperature sensor, and thermal fuse must be produced using a heat-resistant material such as a resin or a metal. In particular, the bearings for rotatably supporting the heater roller is required to possess a high resistance to heat. In addition, since the overall image-fixing device is subject to high temperatures because of the heat generated from the halogen lamp, the image-fixing device must entirely be covered with a heat-insulative member for protecting a user from being burnt when the user removes a recording sheet jammed at the image-fixing device or the user's hand accidentally touches the image-fixing device. Otherwise, the prior image-fixing device must be disposed at a place where the user cannot touch the device. Thus, the construction of the image-fixing device is inevitably complicated, and the overall size of the same increases.

Second, various elements associated with the image-fixing device must be spaced away from the device, so that those elements are prevented from being adversely affected by the heat generated from the device. In addition, heat-insulative members and/or electric funs must be provided between the image-fixing device and other devices such as a photosensitive body, developing device, scanner, toner cartridge, etc. of the printer or copier. For this reason, the construction of the printer or copier is complicated, and the overall size of the same increases.

Third, it takes a long time for the heater roller to have an image-fixing temperature at the outer surface thereof as a result of conduction of the heat generated from the halogen lamp to the inner surface of the heater roller after application of electric power to the image-fixing device. Thus, a long waiting or building-up time is needed before the heater roller is entirely heated to the image-fixing temperature after the halogen lamp is turned on. This is inconvenient for users who wish to start the image-fixing device as soon as possible.

The fourth problem is that the heat radiated from the heater roller is only partly used to thermally fix the toner image on the recording sheet. A considerable portion of the radiated heat is not used. Thus, the prior image-fixing device suffers from low energy efficiency.

The fifth problem is that in the case where a preheating of the heater roller to a raised temperature for reducing the waiting or building-up time is carried out after electric power is initially applied to the image-fixing device and before an image-fixing operation is actually started, the image-fixing device uselessly consumes electric power while no image-fixing operation is carried out.

Sixth, the prior image-fixing device is composed of elements each having a small thermal capacity, for improving the energy efficiency and/or reducing the waiting time. Therefore, there is a tendency that portions of the heater roller other than a portion thereof contacting the recording sheet are raised to excessively high temperatures. It may be considered that if the cross-sectional area of the heater roller is decreased for reducing the thermal capacity thereof, the thermal conductivity of the roller as taken in the longitudinal direction thereof is lowered, therefore heat does not easily conduct in the longitudinal direction and tends to remain locally on the roller.

SUMMARY OF THE INVENTION

It is therefore a first object of the present invention to provide a thermal image-fixing apparatus capable of detecting the occurrence of jamming of various recording sheets having different width and/or thickness values.

The first object has been achieved by the present invention. According to a first aspect of the present invention, there is provided an image-fixing apparatus comprising a presser roller which is rotatable about a first rotation axis thereof; a heater roller which is rotatable about a second rotation axis thereof parallel to the first rotation axis and which is held in contact with the presser roller to provide a nipper for nipping a recording sheet bearing an unfixed image thereon, an electric resistance of the heater roller decreasing as respective contact areas of the heater and presser rollers which areas define the nipper increase; a supplying device which supplies an electricity to the heater roller so that the nipper generates a thermal energy to thermally fix the unfixed image on the recording sheet; a measuring device which measures the electricity supplied from the supplying device to the heater roller; a sheet-data obtaining device which obtains sheet data representing at least one of a width and a thickness of the recording sheet; a memory in which is stored a relationship between the at least one of the width and the thickness of the recording sheet and a permission range regarding the electricity; and a control device which stops the supplying of the electricity from the supplying device to the heater roller, when the electricity measured by the measuring device does not fall within the permission range corresponding to the at least one of the width and the thickness of the recording sheet represented by the sheet data obtained by the sheet-data obtaining device.

In the thermal image-fixing apparatus in accordance with the first aspect of the invention, the control device stops the supplying of the electricity from the supplying device to the heater roller, when the electricity measured by the measuring device does not fall within the permission range corresponding to the at least one of the width and the thickness of the recording sheet represented by the sheet data obtained by the sheet-data obtaining device. In the case where the recording sheet is jammed at the nipper provided by the heater and presser rollers and consequently the "effective" area of the nipper defined by the respective contact (or deformed) areas of the two rollers increase, the electric resistance of the heater roller decreases, so that the electric current of the electricity supplied to the heater roller may be increased to an excessively high level to maintain the electric voltage of the electricity at a constant level. In this case, the control device stops the supplying of the electricity from the supplying device to the heater roller, thereby effectively preventing various elements provided around the present image-fixing device from being damaged by an excessively great amount of heat generated from the heater roller. In addition, in the case where the memory stores the relationship which provides lower permission ranges for smaller widths of the recording sheet, the control device may be adapted to stop the supplying of the electricity for the smaller widths of the recording sheet, and not to stop it for the greater widths of the same, at the same measured electricity. Thus, the present image-fixing apparatus detects the occurrence of jamming of various recording sheet having different width and/or thickness values.

In a preferred embodiment in accordance with the first aspect of the invention, the heater roller comprises: (a) a cylindrical resilient layer which is formed of an electrically insulating and resilient material, is concentric with the second rotation axis, and has a plurality of through holes formed through a thickness thereof; (b) a first cylindrical electrode layer which is concentric with the second rotation axis and has a plurality of electrodes each of which extends into a corresponding one of the through holes of the resilient layer; (c) a cylindrical resistant layer concentric with the second rotation axis, the resistant layer and the first electrode layer sandwiching the resilient layer; and (d) a second cylindrical electrode layer concentric with the second rotation axis, the second electrode layer and the resilient layer sandwiching the resistant layer, a portion of the resilient layer corresponding to the nipper being resiliently deformable so that a portion of the first electrode layer corresponding to the nipper is held in electric contact via the electrodes thereof corresponding to the nipper with a portion of the resistant layer corresponding to the nipper, the supplying device supplying the electricity to the heater roller through the first and second electrode layers so that the portion of the resistant layer corresponding to the nipper generates the thermal energy to thermally fix the unfixed image on the recording sheet. When the recording sheet is jammed at the nipper, the "effective" area of the nipper increases and the number of the electrodes of the first electrode layer corresponding to the nipper increases, so that the electric resistance of the heater roller decreases.

In another embodiment in accordance with the first aspect of the invention, the sheet-data obtaining device comprises a sheet-dimension measuring device which measures, as the sheet data, the at least one of the width and the thickness of the recording sheet.

In yet another embodiment in accordance with the first aspect of the invention, the control device comprises: control means for controlling the supplying of the electricity from the supplying device to the heater roller, so that the electricity measured by the measuring device falls within a control range fully covered by the permission range; and stopping means for stopping the supplying of the electricity from the supplying device to the heater roller when the controlling of the control means regarding the supplying of the electricity is not effective in causing the electricity measured by the measuring device to remain within the control range and eventually the measured electricity has deviated from the permission range. In the case where the control amount of the control device has reached an upper limit beyond which the electric construction of the electricity supplying device cannot respond to command signals from the control device to change, i.e., increase or decrease the electricity supplied to the heater roller, or in the case where the amount or rate of decreasing of the electric resistance of the heater roller because of jamming of the recording sheet is much greater than the amount or rate of decreasing of the electricity supply under the control of the control device, the control device may not be effective in causing the electricity measured by the measuring device to remain within the control range and therefore the measured electricity may eventually deviate from the permission range. In either case, the stopping means stops the supplying of the electricity from the supplying device to the heater roller, thereby effectively preventing the heater roller from generating an excessively great amount of thermal energy.

It is a second object of the present invention to provide a thermal image-fixing apparatus capable of fixing an unfixed image on a recording sheet with an appropriate amount of thermal energy.

The second object has been achieved by the present invention. According to a second aspect of the present invention, there is provided an image-fixing apparatus comprising: a presser roller which is rotatable about a first rotation axis thereof; a heater roller which is rotatable about a second rotation axis thereof parallel to the first rotation axis and which is held in contact with the presser roller to provide a nipper for nipping a recording sheet bearing an unfixed image thereon, an electric resistance of the heater roller decreasing as respective contact areas of the heater and presser rollers which areas define the nipper increase; a supplying device which supplies an electricity to the heater roller so that the nipper generates a thermal energy to thermally fix the unfixed image on the recording sheet; a measuring device which measures the electricity supplied from the supplying device to the heater roller; a first sheet-data obtaining device which obtains first sheet data representing at least one thermal parameter of the recording sheet; a first memory in which is stored a first relationship between the at least one thermal parameter of the recording sheet and a control range regarding the electricity; and a control device which controls the supplying of the electricity from the supplying device to the heater roller, so that the electricity measured by the measuring device falls within the control range corresponding to the at least one thermal parameter of the recording sheet represented by the first sheet data obtained by the first sheet-data obtaining device.

In the thermal image-fixing apparatus in accordance with the second aspect of the invention, the control device controls the supplying of the electricity from the supplying device to the heater roller, so that the electricity measured by the measuring device falls within the control range corresponding to the at least one thermal parameter of the recording sheet represented by the first sheet data obtained by the first sheet-data obtaining device. For example, in the case where the electric resistance of the heater roller changes because of use of various recording sheets having, e.g., different thickness values, the control device controls the electricity supplied to the heater roller so as to fall within the control range. Thus, the present image-fixing apparatus fixes an unfixed image on each recording sheet with an appropriate amount of thermal energy.

In a preferred embodiment in accordance with the second aspect of the invention, the heater roller comprises: (a) a cylindrical resilient layer which is formed of an electrically insulating and resilient material, is concentric with the second rotation axis, and has a plurality of through holes formed through a thickness thereof; (b) a first cylindrical electrode layer which is concentric with the second rotation axis and has a plurality of electrodes each of which extends into a corresponding one of the through holes of the resilient layer; (c) a cylindrical resistant layer concentric with the second rotation axis, the resistant layer and the first electrode layer sandwiching the resilient layer; and (d) a second cylindrical electrode layer concentric with the second rotation axis, the second electrode layer and the resilient layer sandwiching the resistant layer, a portion of the resilient layer corresponding to the nipper being resiliently deformable so that a portion of the first electrode layer corresponding to the nipper is held in electric contact via the electrodes thereof corresponding to the nipper with a portion of the resistant layer corresponding to the nipper, the supplying device supplying the electricity to the heater roller through the first and second electrode layers so that the portion of the resistant layer corresponding to the nipper generates the thermal energy to thermally fix the unfixed image on the recording sheet.

In another embodiment in accordance with the second aspect of the invention, the first sheet-data obtaining device comprises a sheet-parameter measuring device which measures, as the first sheet data, the at least one thermal parameter of the recording sheet. The sheet-parameter measuring device may measure, as the at least one thermal parameter of the recording sheet, at least one of a width, a thickness, a surface roughness, and a moisture content of the recording sheet.

In yet another embodiment in accordance with the second aspect of the invention, the image-fixing apparatus further comprises a second sheet-data obtaining device which obtains second sheet data representing at least one of a width and a thickness of the recording sheet; and a second memory in which is stored a second relationship between the at least one of the width and the thickness of the recording sheet and a permission range regarding the electricity. The second memory may store, as the second relationship, a second data table including a plurality of permission ranges corresponding to a plurality of values of the at least one of the width and the thickness of the recording sheet. The control device may comprise: second selecting means for selecting, from the second data table stored in the second memory, one of the permission ranges corresponding to the at least one of the width and the thickness of the recording sheet represented by the second sheet data obtained by the second sheet-data obtaining device; and stopping means for stopping the supplying of the electricity from the supplying device to the heater roller, when the electricity measured by the measuring device does not fall within the selected one permission range. The selected one permission range may fully cover the control range. In the last case, the difference of the respective upper limits of the selected control and permission ranges and the difference of the respective lower limits of the selected two ranges may be pre-determined to define an upper and a lower limit of a "rate" permission range for the rate of change of the electricity supplied to the heater roll, respectively. If the difference of two values of the electricity measured by the measuring device during two successive control cycles of the control device exceeds the upper or lower limit of the "rate" permission range, then the stopping means stops the supplying of the electricity to the heater roller, because the jamming of the recording sheet has occurred at the nipper.

It is a third object of the present invention to provide a thermal image-fixing apparatus capable of quickly detecting the occurrence of jamming of a recording sheet bearing an unfixed image thereon.

The third object has been achieved by the present invention. According to a third aspect of the present invention, there is provided an image-fixing apparatus comprising: a presser roller which is rotatable about a first rotation axis thereof; a heater roller which is rotatable about a second rotation axis thereof parallel to the first rotation axis and which is held in contact with the presser roller to provide a nipper for nipping a recording sheet bearing an unfixed image thereon, an electric resistance of the heater roller decreasing as respective contact areas of the heater and presser rollers which areas define the nipper increase; a supplying device which supplies an electricity to the heater roller so that the nipper generates a thermal energy to thermally fix the unfixed image on the recording sheet; a measuring device which measures the electricity supplied from the supplying device to the heater roller; and a sheet-jamming detecting device which detects a jamming of the recording sheet at the nipper, based on the electricity measured by the measuring device.

In the thermal image-fixing apparatus in accordance with the third aspect of the invention, the sheet-jamming detecting device detects a jamming of the recording sheet at the nipper, based on the electricity measured by the measuring device. When the jamming of the recording sheet occurs at the nipper, the "effective" area of the nipper increases and accordingly the electric resistance of the heater roller decreases, so that the electricity supplied to the heater roller may increase. In this case, the sheet-jamming detecting device detects a jamming of the recording sheet at the nipper, based on the increasing of the electricity measured by the measuring device. The increasing of the electricity may be either an amount or a rate of increasing of the electricity.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Figure 1:
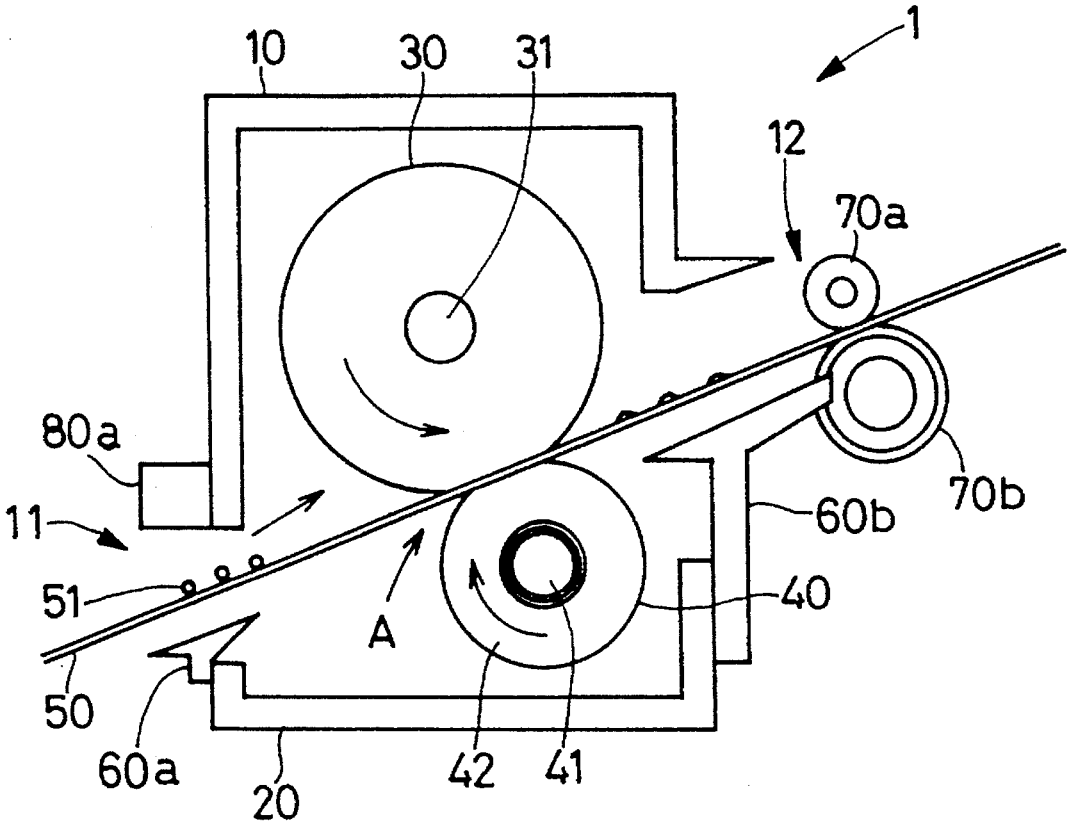
FIG. 1 is a cross-sectional view of a thermal image-fixing apparatus embodying the present invention, taken along line 1—1 in FIG. 2.
Figure 2:
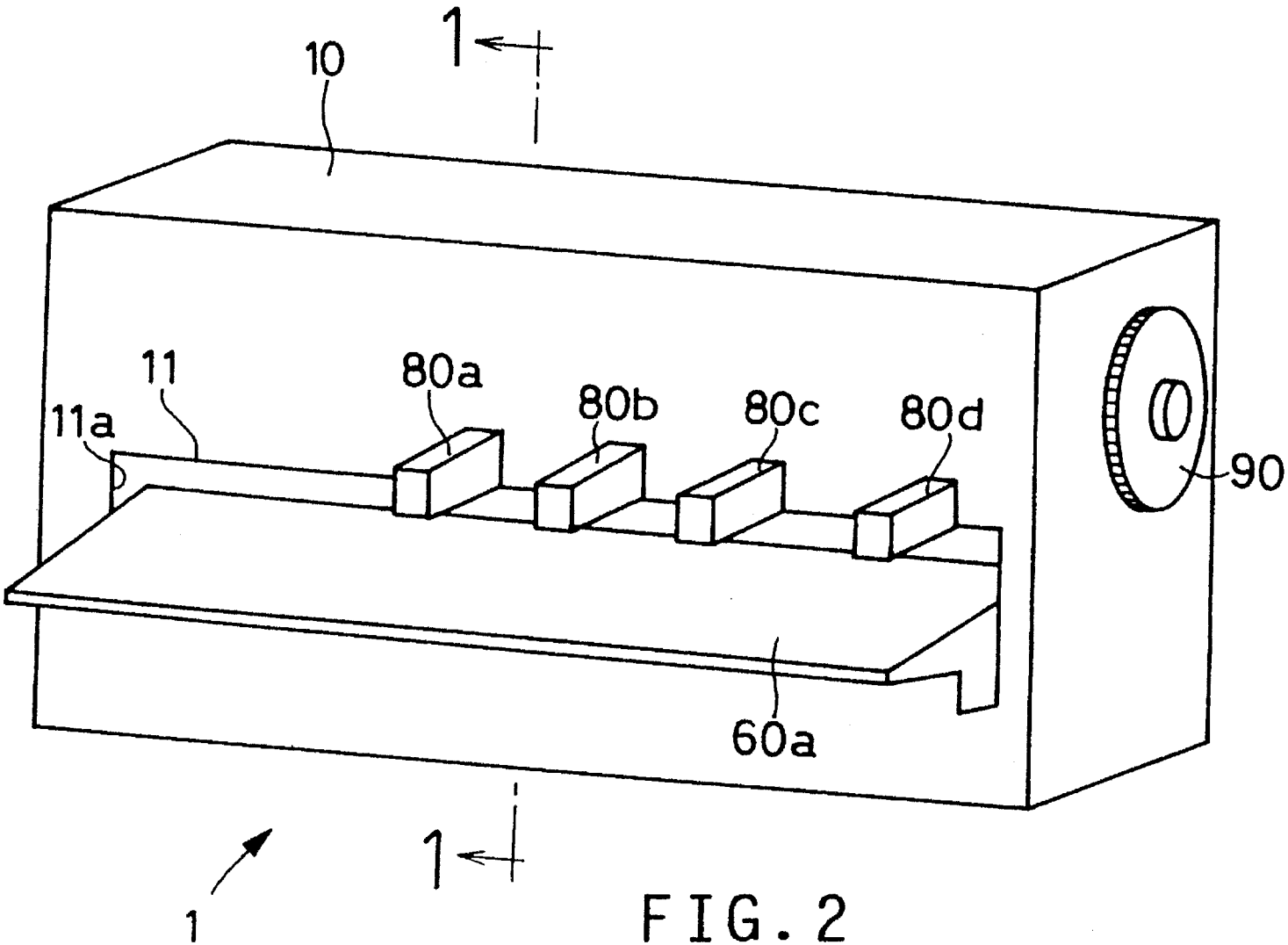
FIG. 2 is a perspective view of the image-fixing apparatus of FIG. 1.

Referring first to FIGS. 1 and 2, there is shown a thermal image-fixing apparatus 1 embodying the present invention. The image-fixing apparatus 1 may be employed in a printer of an electrophotographic type, for example.

The image-fixing apparatus 1 includes an upper and a lower covering 10, 20 each of which has a generally U-shaped cross section as seen in FIG. 1. The upper and lower coverings 10, 20 cooperate with each other to define, on one hand, a sheet inlet 11 through which a recording sheet 50 bearing an unfixed toner image 51 thereon is fed in and, on the other hand, a sheet outlet 12 through which the recording sheet 50 bearing the toner image 51 which has thermally been fixed is fed out.

The image-fixing apparatus 1 also includes a heater roller 30 rotatably supported by the wall of the upper covering 10, and a presser roller 40 rotatably supported by the lower covering 20. The heater roller 30 includes a first axis member 31 rotatably supported at opposite axial ends 31*a*, 31*b* (FIG. 5) thereof via respective bearings (not shown) by the wall of the upper covering 10.

The presser roller 40 includes a second axial member 41 rotatably supported at opposite axial ends thereof via respective bearings (not shown) by the wall of the lower covering 20. The presser roller 40 additionally includes a resilient roller body 42 provided on the outer circumferential surface of the second axis member 41. The roller body 42 is formed of a heat-resistant, resilient material such as a silicone rubber. The roller body 42 of the presser roller 40 is held in contact with the heater roller 30, so that a nipper, A, is provided for nipping the recording sheet 50 being fed in through the sheet inlet 11. At the nipper A, the roller body 42 of the presser roller 40 is resiliently deformable as shown in FIG. 1.

In the present image-fixing apparatus 1, the toner image 51 is fixed on the recording sheet 50 by fusing the toner with a thermal energy generated by the heater roller 30 in a manner described later. For thermally fixing the toner image 51 on the recording sheet 50, the heater roller 30 and the presser roller 40 are rotated in respective directions indicated at arrows in FIG. 1 so as to feed the recording sheet 50 forward in a direction indicated at an arrow, at an appropriate speed. Thus, the present image-fixing apparatus 1 has two functions, one is to feed the recording sheet 50 and the other is to thermally fuse the toner and thereby fixing the toner image 51 on the sheet 50. The second axis member 41 of the presser roller 40 is connected via gears (not shown) to the first axis member 31 of the heater roller 30, so that the rotation of the presser roller 40 is interlocked with the rotation of the heater roller 30. In FIG. 1, reference numerals 60*a*, 60*b* respectively designate an inlet-side sheet guide and an outlet-side sheet guide each for guiding the recording sheet 50, and reference numerals 70*a*, 70*b* designate a pair of sheet discharging rollers for discharging the recording sheet 50 out of the present apparatus 1.

FIG. 2 shows the external appearance of the present image-fixing apparatus 1. The apparatus 1 further includes four reflection-type optical sensors 8*a*, 8*b*, 8*c*, 8*d* which cooperate with each other to measure the width of the recording sheet 50. The array of four optical sensors 8*a* to 8*d* are supported by the upper covering 10, along the sheet inlet 11. In the present apparatus 1, the recording sheet 50 is fed in via the sheet inlet 11 such that a left-hand end 11*a* of the inlet 11 is used as a reference for the feeding of the sheet 50. For example, the recording sheet 50 is fed in while the left-hand edge of the sheet 50 keeps a prescribed distance from the left-hand end 11*a* of the sheet inlet 11. The first sensor 80*a* detects a recording sheet 50 of a B5 size; the first and second sensors 80*a*, 80*b* detect an A4-size sheet 50; the first to third sensors 80*a* to 80*c* detect a B4-size sheet 50; and the first to fourth sensors 80*a* to 80*d* detect an A3-size sheet 50. Each of the B5, A4, B4, and A3 sizes defines the prescribed length and width of a corresponding cut sheet in accordance with Japanese Industrial Standards (JIS). Reference numeral 90 designates a gear for transmitting a driving force to the first axis member 31 of the heater roller 30.

Hereinafter, there will be described in detail the construction of the heater roller 30 by reference to FIGS. 3 to 7. The heater roller 30 has the two functions, one is to feed the recording sheet 50 and the other is to generate a thermal energy at the nipper A and thermally fuse the toner and thereby fix the toner image 51 on the sheet 50. The first axis member 31 of the heater roller 30 is formed of a metallic material. The heater roller 30 additionally includes a cylindrical base body 32 which is provided on the outer circumferential surface of the first axis member 31 concentrically with the axis member 31. The base body 32 is formed of a more or less resilient, electrically insulating material such as a rubber or a resin.

Figure 4A:
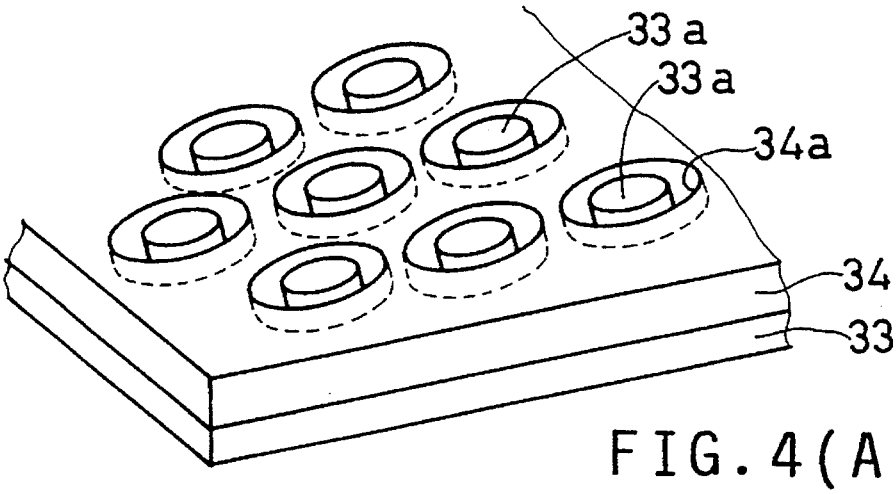
FIG. 4(A) is an enlarged perspective view of respective portions of an inner electrode layer and a resilient layer of the heater roller of FIG. 3.
Figure 4B:
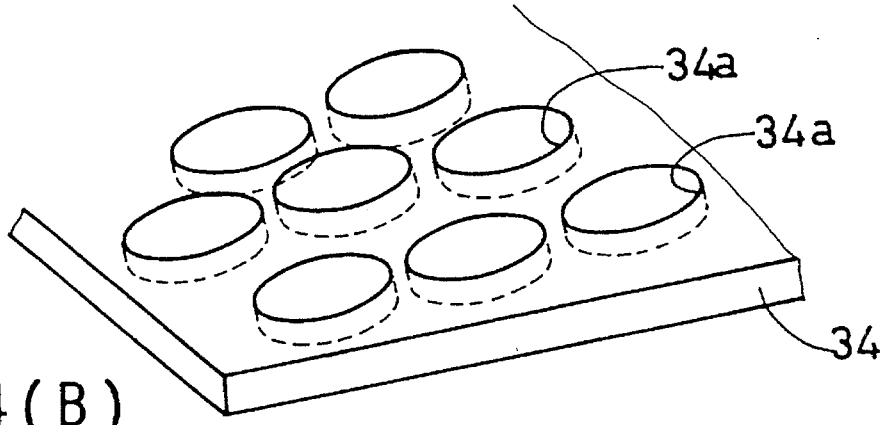
FIG. 4(B) is an enlarged perspective view of a portion of the resilient layer of the heater roller of FIG. 3.
Figure 4C:
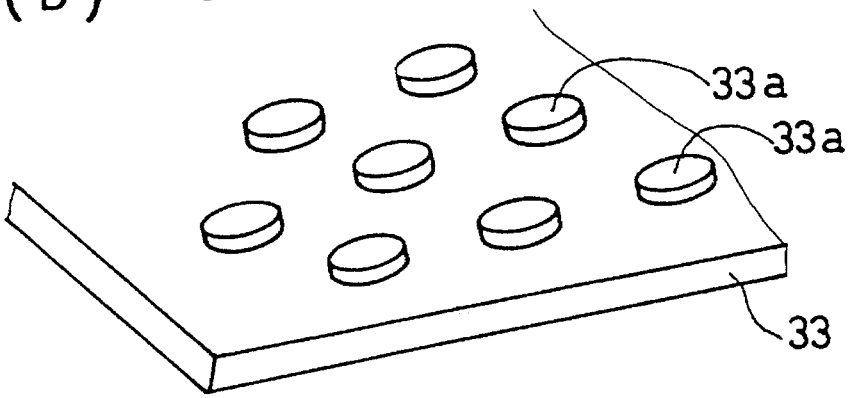
FIG. 4(C) is an enlarged perspective view of a portion of the inner electrode layer of the heater roller of FIG. 3.

The heater roller 30 further includes a cylindrical inner electrode layer 33 which is fit on the outer circumferential surface of the base body 32 concentrically with the first axis member 31. The inner electrode layer 33 is formed of an electrically conducting metallic material such as an aluminum-based material. As shown in FIGS. 4(*a*) and 4(*c*), the inner electrode layer 33 includes, on the outer circumferential surface thereof, a multiplicity of columnar electrodes 33*a* which are arranged in prescribed arrays and spaced away from each other. Upon application of an electricity to the inner electrode layer 33, the electricity is conductable to the electrodes 33*a* via the inner electrode layer 33. In the present embodiment, each electrode 33*a* is formed of a heat-resistant and wearing-resistant metallic material such as tungsten, because the top end of each electrode 33*a* is subject to high temperatures and high pressures. Each electrode 33*a* may take a different shape than the columnar shape, such as a cubic or semi-spherical shape. The electrodes 33*a* may otherwise be formed of the same material as the material of the inner electrode layer 33, and may also be formed integrally with the same 33.

Figure 3:
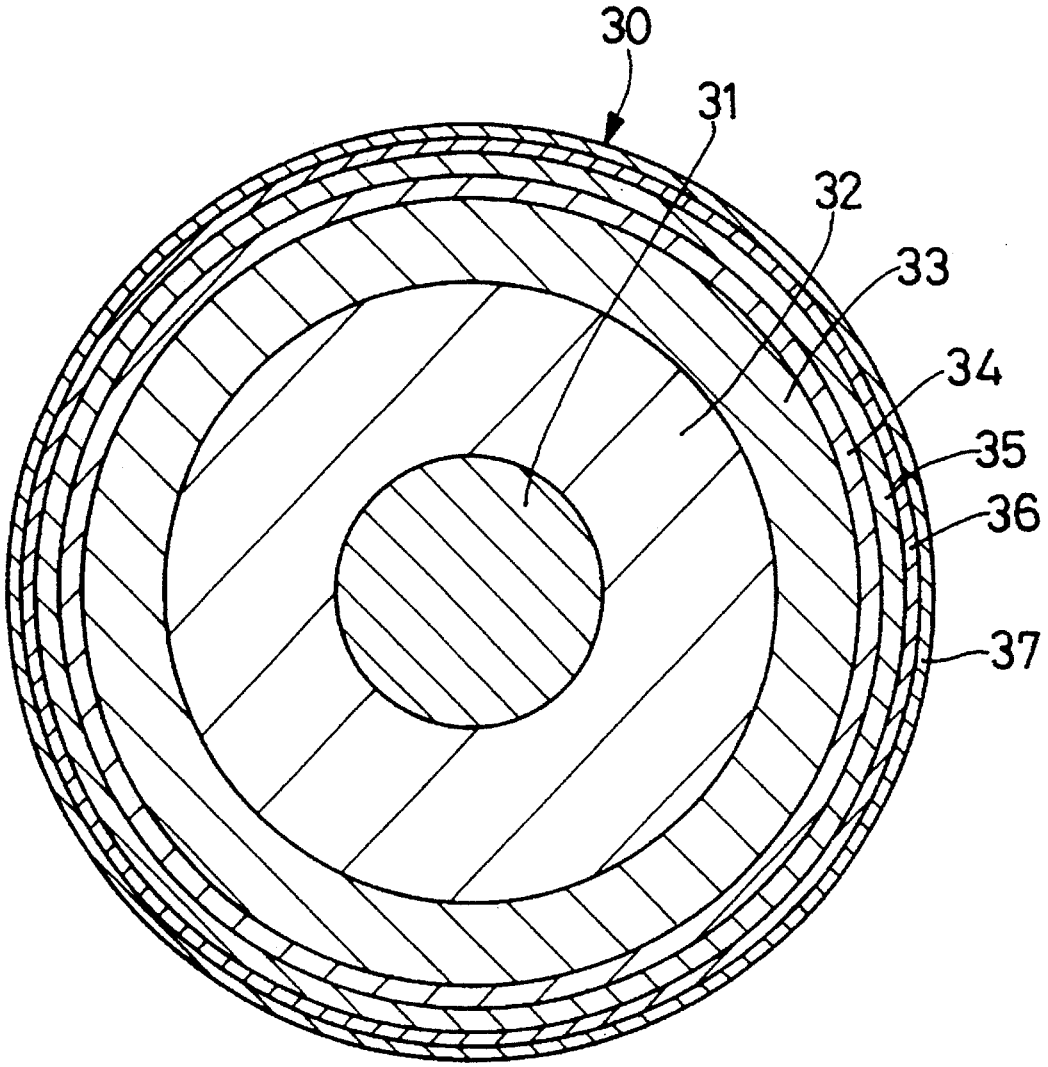
FIG. 3 is an enlarged cross-sectional view of a heater roller of the image-fixing apparatus of FIG. 1.

The heater roller 30 further includes a cylindrical resilient layer 34 which is formed of an electrically insulating, resilient material and which is fit on the outer circumferential surface of the inner electrode layer 33 concentrically with the first axis member 31 as shown in FIG. 3. The resilient material may be selected from natural rubber (NR), isoprene rubber (IR), butadiene rubber (BR), styrene butadiene rubber (SBR), butyl rubber (IIR), ethylene propylene rubber (EPM, EPDM), silicone rubber (Si), chloroprene rubber (CR), hypalon (CSM), fluoro rubber (FPM), and urethane rubber (V). As shown in FIGS. 4(*a*) and 4(*b*), the resilient layer 34 has a plurality of cylindrical through holes 34*a* each formed through the thickness thereof. As shown in FIG. 4(*a*), each of the columnar electrodes 33*a* extends into a corresponding one of the cylindrical through holes 34*a* of the resilient layer 34 substantially concentrically with the corresponding one through hole 34*a*. The depth of each through hole 34*a* is greater than the height of each electrode 33*a*. With the resilient layer 34 being assembled on the inner electrode layer 33, the top end of each electrode 33*a* does not reach the level of the outer circumferential surface of the resilient layer 34, i.e., the level of the top end of each through hole 34*a*. The diameter of each through hole 34*a* is greater than the diameter of each electrode 33*a*.

The heater roller 30 further includes a cylindrical resistant layer 35 which is formed of a material obtained by dispersing carbon particles in a polycarbonate film and which has a thickness of about 20 micrometers (μm) and a prescribed volume resistivity. As shown in FIG. 3, the resistant layer 35 is fit on the outer circumferential surface of the resilient layer 34 concentrically with the first axis member 31. The resistant layer 35 and the inner electrode layer 33 sandwiches the resilient layer 34 located therebetween.

The heater roller 30 further includes a cylindrical outer electrode layer 36 which is formed by vacuum deposition of a material such as aluminum and which has a thickness of about 1,000 angstroms to 0.2 millimeters (mm) and which is fit on the outer circumferential surface of the resistant layer 35 concentrically with the first axis member 31.

The heater roller 30 additionally includes a cylindrical protection layer 37 which is formed of a material such as ethylene tetrafluoride and which is fit on the outer circumferential surface of the outer electrode layer 36 concentrically with the first axis member 31. The protection layer 37 defines the outer circumferential surface of the heater roller 30, and prevents the toner on the recording sheet 50 from being adhered by fusing to the heater roller 30.

Figure 5:
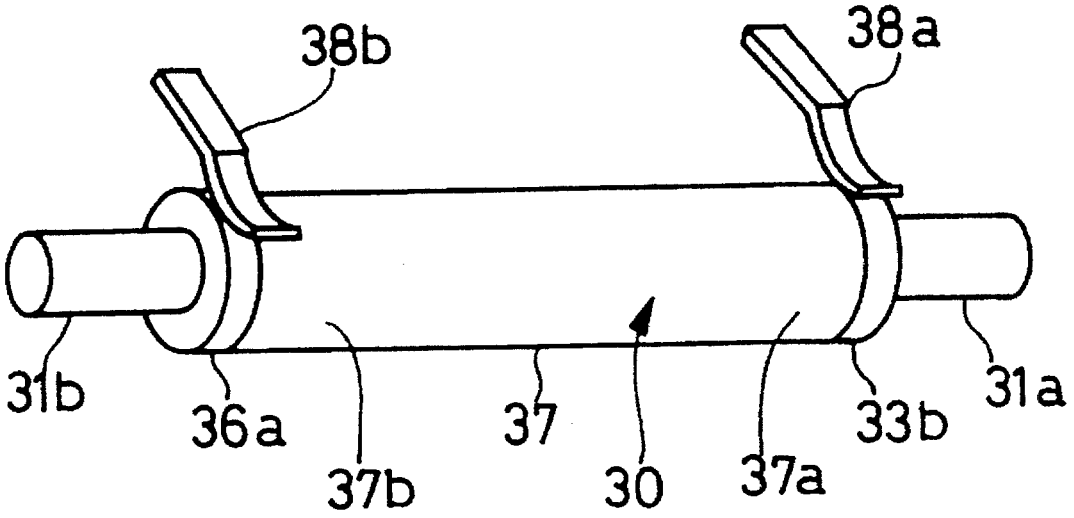
FIG. 5 is a perspective view of the heater roller of FIG. 3.

As shown in FIG. 5, respective right-hand ends 37*a* of the resilient layer 34, resistant layer 35, outer electrode layer 36, and protection layer 37 are short, so that a right-hand end 33*b* of the inner electrode layer 33 is exposed. A free end of a positive electrode 38*a* is held in electric contact with the right-hand end 33*b* of the inner electrode layer 33. Meanwhile, a left-hand end 37*b* of the protection layer 37 is short, so that a left-hand end 36*a* of the outer electrode layer 36 is exposed. A free end of a negative electrode 38*b* is held in electric contact with the left-hand end 36*a* of the outer electrode layer 36. The positive and negative electrodes 38*a*, 38*b* are fixed at respective base portions thereof to the wall of the upper covering 10.

Figure 6:
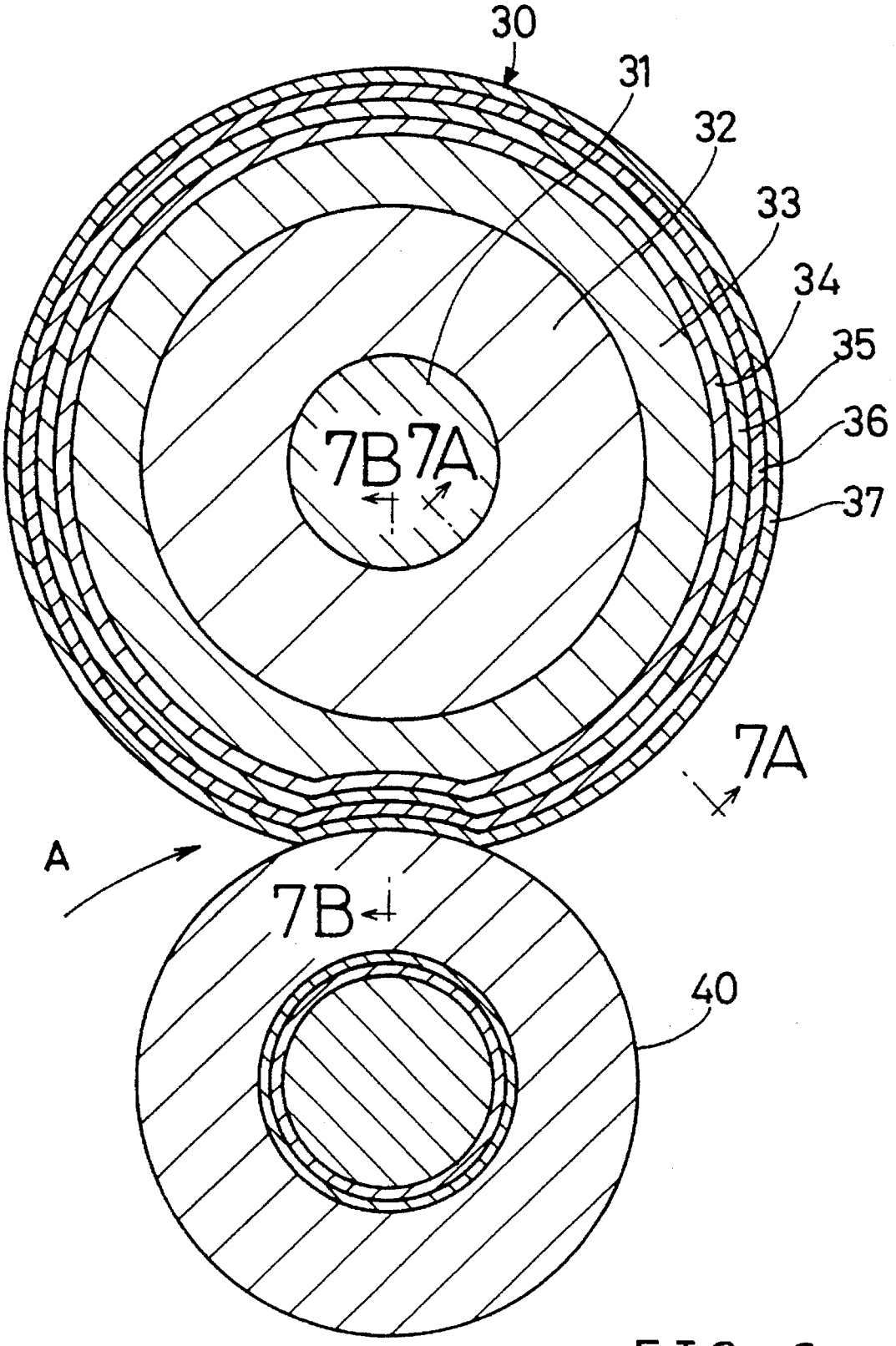
FIG. 6 is an enlarged cross-sectional view of a nipper, A, provided by the heater roller and a presser roller of the image-fixing apparatus of FIG. 1.

As shown in FIG. 6, the presser roller 40 is held in contact with the heater roller 30 so as to provide the nipper A for nipping the recording sheet 50 on which the unfixed toner image 51 has been formed. A portion of the resilient layer 34 of the heater roller 30 corresponding to the nipper A is resiliently deformable to become thinner so that a portion of the inner electrode layer 33 of the heater roller 30 corresponding to the nipper A is held in electric contact via the electrodes 33*a* corresponding to the nipper A with a portion of the resistant layer 35 of the heater roller 30 corresponding to the nipper A. Similarly, the resilient roller body 42 of the presser roller 40 is resiliently deformable because of the contact with the heater roller 30, and becomes thinner at the nipper A. Thus, the nipper A provides a sufficient pressing area and force for thermally fixing the toner image 51 on the recording sheet 50.

Figure 7A:
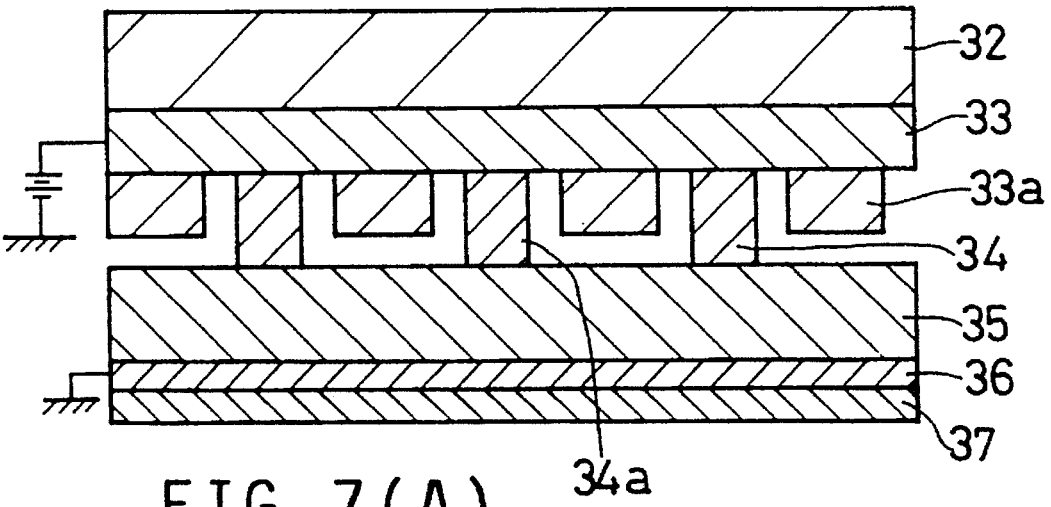
FIG. 7(A) is an enlarged cross-sectional view of a portion of the heater roller of FIG. 3 taken along line 7A—7A in FIG. 6 and not corresponding to the nipper A.
Figure 7B:
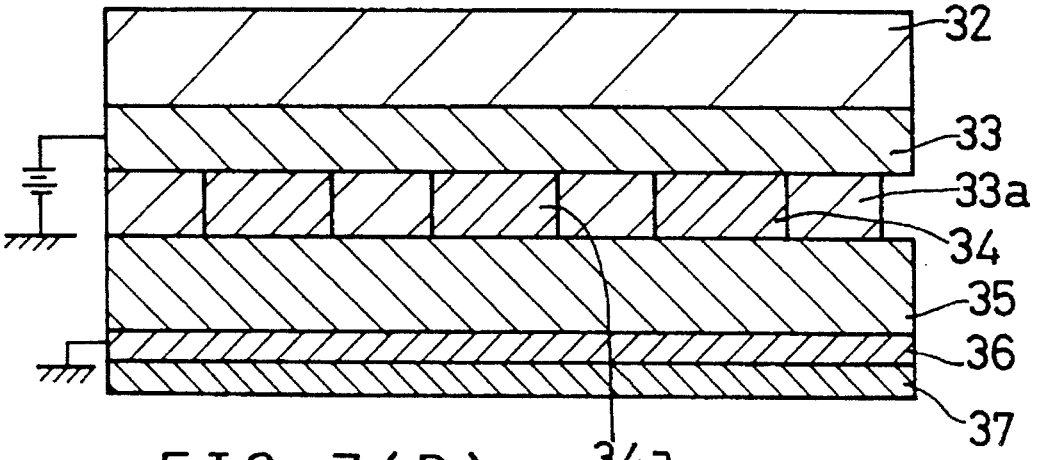
FIG. 7(B) is an enlarged cross-sectional view of a portion of the heater roller of FIG. 3 taken along line 7B—7B in FIG. 6 and corresponding to the nipper A.

While the "nipper" portion of the resilient layer 34 currently corresponding to the nipper A is resiliently deformed, the remaining portion of the resilient layer 34 other than the "nipper" portion thereof is not deformed. Therefore, the electrodes 33*a* of the inner electrode layer 33 corresponding to the remaining, undeformed portion of the resilient layer 34 are kept apart from the resistant layer 35, as shown in FIG. 7(A). Thus, a direct current cannot flow through the resistant layer 35. On the other hand, at the nipper A where the heater and presser rollers 30, 40 are held in contact with each other, the resilient layer 34 is deformed and made thinner, so that the electrodes 33*a* of the inner electrode layer 33 are brought into electric contact with the resistant layer 35, as shown in FIG. 7(B), and so that an electricity is conductable through the resistant layer 35. The elements and layers 31, 32, 33, 34, 35, 36, 37 of the heater roller 30 are uniformly adhered at respective interfaces thereof to each other with a suitable adhesive force produced by an adhesive or a vapor deposition.

Figure 8:
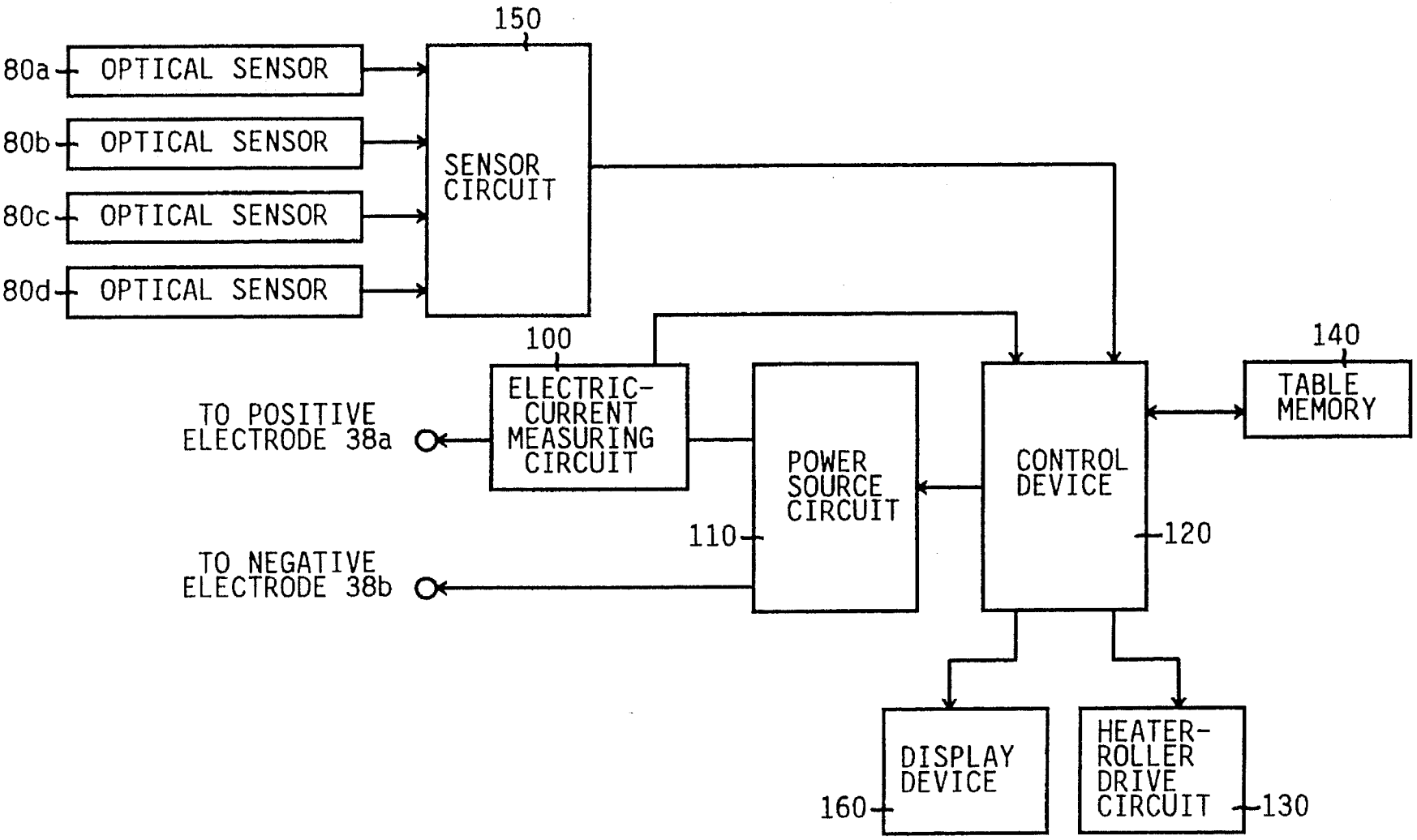
FIG. 8 is a diagrammatic view of the electric circuit of the image-fixing apparatus of FIG. 1.

Next, there will be described the electric circuit of the present image-fixing apparatus 1 by reference to FIG. 8.

A sensor circuit 150 receives respective detection signals from the four optical sensors 80*a*, 80*b*, 80*c*, 80*d*, and supplies a sheet-size signal representing the detected size of the recording sheet 50, to a control device 120 which is constituted by a microcomputer. A table memory 140 such as a read only memory (ROM) stores a table representing a relationship between (A) the B5, A4, B4, and A3 sizes of recording sheets 50 and (B) (b1) corresponding center electric current values, Ia, and (b2) corresponding permission half-width values, C. The control device 120 selects one of the center values Ia and one of the permission half-width values C which corresponds to the detected size of the recording sheet 50 represented by the sheet-size signal from the sensor circuit 150.

A heater-roller drive circuit 130 generates a drive signal and a stop signal to rotate or stop the heater roller 30, according to respective control signals supplied from the control device 120. A display device 160 displays a "jamming" indication, as described later, when a sheet jamming has occurred at the nipper A.

An electric-current measuring circuit 100 measures the magnitude of a direct electric current flowing into the exposed end 33*b* of the inner electrode layer 33 of the heater roller 30 via the positive electrode 38*a* from an electric power source circuit 110, and generates an electric-current signal representing the detected magnitude of the electric current. The positive terminal of the power source circuit 110 is connected to the positive electrode 38*a* via the electric-current measuring circuit 100, and the negative terminal of the power source circuit 110 is connected to the negative electrode 38*b*. The power source circuit 110 adjusts, under the control of the control device 120, the magnitude of the electric current flowing between the exposed end 33*b* of the inner electrode layer 33 and the the exposed end 36*a* of the outer electrode layer 36 via the electric-current measuring circuit 100 and the positive and negative electrodes 38*a*, 38*b*.

Figure 9:
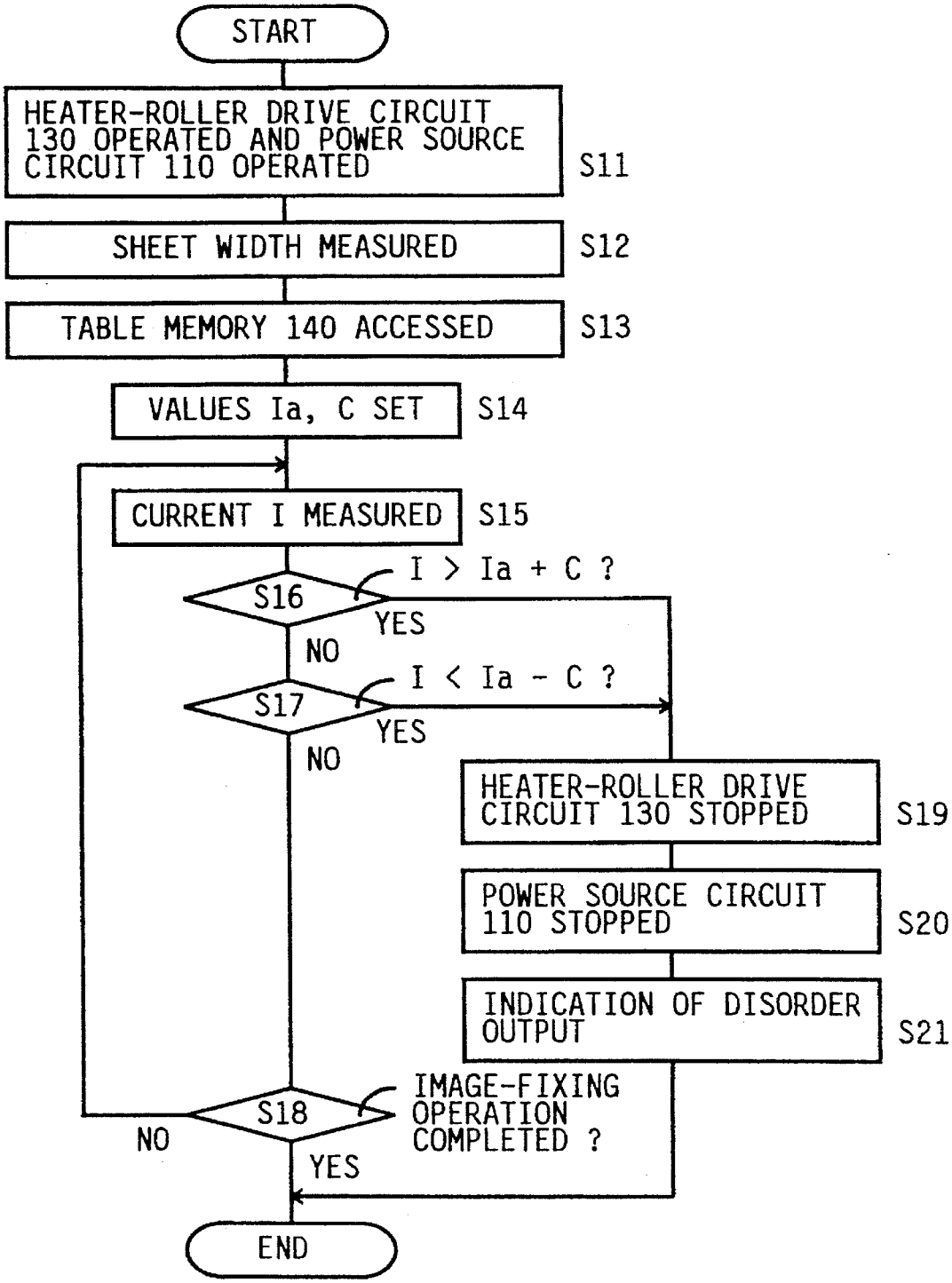
FIG. 9 is a flow chart according to which the image-fixing apparatus of FIG. 1 is operated.

The control device 120 cooperates with the sensor circuit 150 and the electric-current measuring circuit 100 to execute a control program represented by the flow chart of FIG. 9. Thus, the control device 120 supplies control signals to the power source circuit 110 and the heater-roller drive circuit 130. The above-indicated control program is pre-stored in a read only memory (ROM, not shown) of the control device 120.

Hereinafter, there will be described the operation of the present apparatus 1 constructed as described above for thermally fixing the unfixed toner image 51 on the recording sheet 50. Once the present apparatus 1 is placed in an operative state, the control device 120 starts executing the control program represented by the flow chart of FIG. 9. It is assumed that, at this point of time, the recording sheet 50 on which the unfixed toner image 51 has been formed is being nipped by the nipper A provided by the cooperation of the heater roller 30 and the presser roller 40, as shown in FIG. 1. As described above, at the nipper A, some electrodes 33*a* of the inner electrode layer 33 are held in contact with the resistant layer 35 via the deformed portion of the resilient layer 34 (FIG. 7(B)). It is also assumed that at this point of time no electric voltage is being applied to the heater roller 30.

First, at Step 11, a central processing unit (CPU, not shown) of the control device 120 supplies a drive command signal to the heater-roller drive circuit 130 to rotate the heater roller 30, and an application command signal to the power source circuit 110 to apply a direct electric current to the heater roller 30. Thus, the heater roller 30 is rotated together with the presser roller 40 by being driven by the drive circuit 130, and simultaneously the power source circuit 110 supplies a direct electric current to a portion of the heater roller 30 corresponding to the nipper A via the positive and negative electrodes 38*a*, 38*b* and the exposed ends 33*b*, 36*a* of the inner and outer electrode layers 33, 36. Consequently the recording sheet 50 is fed by the rotations of the heater and presser rollers 30, 40 while being nipped by the nipper A, and simultaneously the direct current flows through a closed circuit constituted by the power source circuit 110, the electric-current measuring circuit 100, the positive electrode 38*a*, the inner electrode layer 33, and the electrodes 33*a* corresponding to the nipper A, the resistant layer 35, the outer electrode layer 36, and the negative electrode 38*b*. Thus, at only the nipper portion of the heater roller 30, the resistant layer 35 generates an amount of heat corresponding to the magnitude of resistivity thereof as a result of the flowing of the direct current therethrough. The thermal energy corresponding to the generated heat is conducted from the resistant layer 55 to the recording sheet 50 via respective portions of the outer electrode layer 36 and the protection layer 37 corresponding to the nipper A. The conducted thermal energy fuses the toner on the recording sheet 50, thereby fixing the toner image 51 on the sheet 50, at the nipper A. The thermal fixing of the toner image 51 on the recording sheet 50 is carried out while at the same time the sheet 50 is fed forward by the rotations of the heater and presser rollers 30, 40.

Since each of the outer electrode layer 36 and the protection layer 37 is very thin, the thermal resistance of each layer 36, 37 is very low. Therefore, the thermal energy generated at the resistant layer 35 is conducted with high efficiency to the outer surface of the heater roller 30. Thus, the heater roller 30 is placed very quickly in a fixing-starting state where the heater roller 30 can start the thermal fixation of the toner image 51 on the recording sheet 50. That is, the waiting or building-up time of the heater roller 30 needed to start the thermal image fixation is minimized. Since the heat generation and conduction of the heater roller 30 is limited to the nipper A, the other elements of the present apparatus 1 are effectively prevented from being adversely affected by the heat generated by the heater roller 30. Additionally, the electric consumption of the present apparatus 1 is significantly reduced. Since the number of heat-insulating members employed in the present apparatus 1 can be decreased, the apparatus 1 can be produced in a smaller size.

Step S11 is followed by Step S12 where the control device 120 or the CPU thereof identifies the size of the recording sheet 50 based on the sheet-size signal supplied from the sensor circuit 150. It is assumed that the CPU identifies the B4 size of the recording sheet 50. Subsequently, at Step S13, the CPU selects, from the table memory 140, a center current value Ia and a permission half-width value C each corresponding to the B4-size recording sheet 50. Step S13 is followed by Step S14 to set the selected values Ia, C as control values used to control the electric current supplied to the heater roller 30. Subsequently, at Step S15, the CPU reads an instant magnitude, I, of the electric current flowing through the heater roller 30, based on the electric-current signal supplied from the electric-current measuring circuit 100. Step S15 is followed by Step S16 to judge whether the measured magnitude I of the electric current is greater than an upper limit value obtained by adding the permission half-width value C to the center current value Ia. If a negative judgment is made at Step S16, that is, if the measured value I is not greater than the upper limit Ia+C, the control of the CPU goes to Step S17. At Step S17, the CPU judges whether the measured magnitude I is smaller than a lower limit value obtained by subtracting the permission half-width value C from the center current value Ia. If a negative judgment is made at Step S17, that is, if the measured value I is greater than the lower limit Ia–C, the control of the CPU goes to Step S18.

At Step S18, the CPU judges whether an image-fixing operation has been completed on the recording sheet 50. To this end, a sheet sensor may be employed, which includes a small lever and a photointerrupter. The sheet sensor detects the leading end of the recording sheet 50 when the small lever is first pivoted to interrupt the photointerrupter by being brought into engagement with the recording sheet 50, and detects the trailing end of the sheet 50 when the small lever is again pivoted to interrupt the photointerrupter by releasing from the engagement with the sheet 50. If a negative judgment is made at Step S18, that is, if the image-fixing operation has not been completed, the control of the CPU goes back to Step S15 and the following steps so as to continue the image-fixing operation while monitoring the electric current I flowing through the heater roller 30. Meanwhile, if the image-fixing operation is ended, a positive judgment is made at Step S18, and the current control cycle is ended.

On the other hand, for example, if the recording sheet 50 is jammed at the heater roller 30 and consequently the effective area of the nipper A increases, the number of the electrodes 33*a* brought into electric contact with the resistant layer 35 excessively increases, and the overall electric resistance of the heater roller 30 decreases. Accordingly an excessively great electric current flows through the heater roller 30. In this case, the measured current I exceeds the upper limit Ia+C, and a positive judgment is made at Step S16, so that the control of the CPU of the control device 120 goes to Step S19. At Step S19, the CPU supplies a stop command signal to the heater-roller drive circuit 130 to stop the rotation of the heater roller 30, and at Step S20 the CPU supplies a shut-off command signal to the power source circuit 110 to shut off the supplying of direct-current voltage to the heater roller 30. Consequently the heater-roller drive circuit 130 stops the rotations of the heater and presser rollers 30, 40, and the power source circuit 110 stops the supplying of direct-current voltage to the heater roller 30. Thus, the various elements of the present apparatus 1 are effectively prevented from being deteriorated or even broken by abnormal heat generation or abnormal high temperatures. Step S20 is followed by Step S21 where the control device 120 or the CPU supplies an indication signal to the display device 160 so that the display device 160 displays a "disorder" indication that a disorder (e.g., jamming of the recording sheet 50) has occurred and that the supplying of direct-current voltage to the heater roller 30 has been stopped. Meanwhile, for example, if a certain disorder occurs to the present apparatus 1 and no electric current can flow through the heater roller 30, the present apparatus 1 cannot fix the toner image 51 on the recording sheet 50. In this case, the measured current I becomes smaller than the lower limit Ia–C and a positive judgment is made at Step S17, so that the control of the CPU goes to Step S19 and the following steps as described above.

It emerges from the foregoing description that, in the present embodiment, the table memory 140 stores the data table representing the relationship between the various sizes of recording sheets 50 and the corresponding center current values Ia and corresponding permission half-width values C, the four optical sensors 80*a*–80*d* cooperate with each other to identify the size of each recording sheet 50, and the control device 120 selects the center current value Ia and permission half-width value C corresponding to the identified size of the recording sheet 50. If the measured current I exceeds the upper limit Ia+C, the control device 120 stops the rotations of the heater and presser rollers 30, 40 and stops the supplying of electric current to the heater roller 30, thereby stopping the image-fixing operation being effected on the recording sheet 50.

In the present embodiment, the table memory 140 stores lower center current values Ia and smaller permission half-width values C for narrower recording sheets 50. Therefore, for example, in the case where a narrower recording sheet 50 is jammed and a lower electric current flows than where a wider recording sheet 50 is jammed, the present apparatus 1 can accurately detect the jamming of the narrower sheet 50 and quickly stops the image-fixing operation being effected on the sheet 50. On the other hand, in the case where a higher electric current is measured while an image-fixing operation is effected on a wider recording sheet 50, the present apparatus 1 cannot erroneously identifies that the wider sheet 50 is being jammed.

Additionally, the table memory 140 stores different permission half-width values C for different sheet sizes. Each of the half-width values C may be given a special considerations practically needed for a corresponding sheet size. For example, a recording sheet 50 identified as having a post-card size would probably be a post card, and the thickness of a post card is greater than that of a common cut sheet having a comparable size. In the case where a toner image 51 is fixed on a post card 50, the effective area of the nipper A increases because of the greater thickness of the post card 50 and accordingly a greater current flows than expected from the post-card size of the recording sheet 50. Therefore, in the present embodiment, the table memory 140 provides a greater permission half-width value C for the post-card size, for avoiding an erroneous identification that a post card-size recording sheet 50 (this would probably be a post card) is being jammed. On the other hand, a recording sheet 50 having the A4 size would probably be a common cut sheet, therefore the table memory 140 provides a smaller permission half-width value C for the A4 size, for more quickly finding the jamming of the A4-size recording sheet 50 (this would probably be a common cut sheet).

Figure 10:
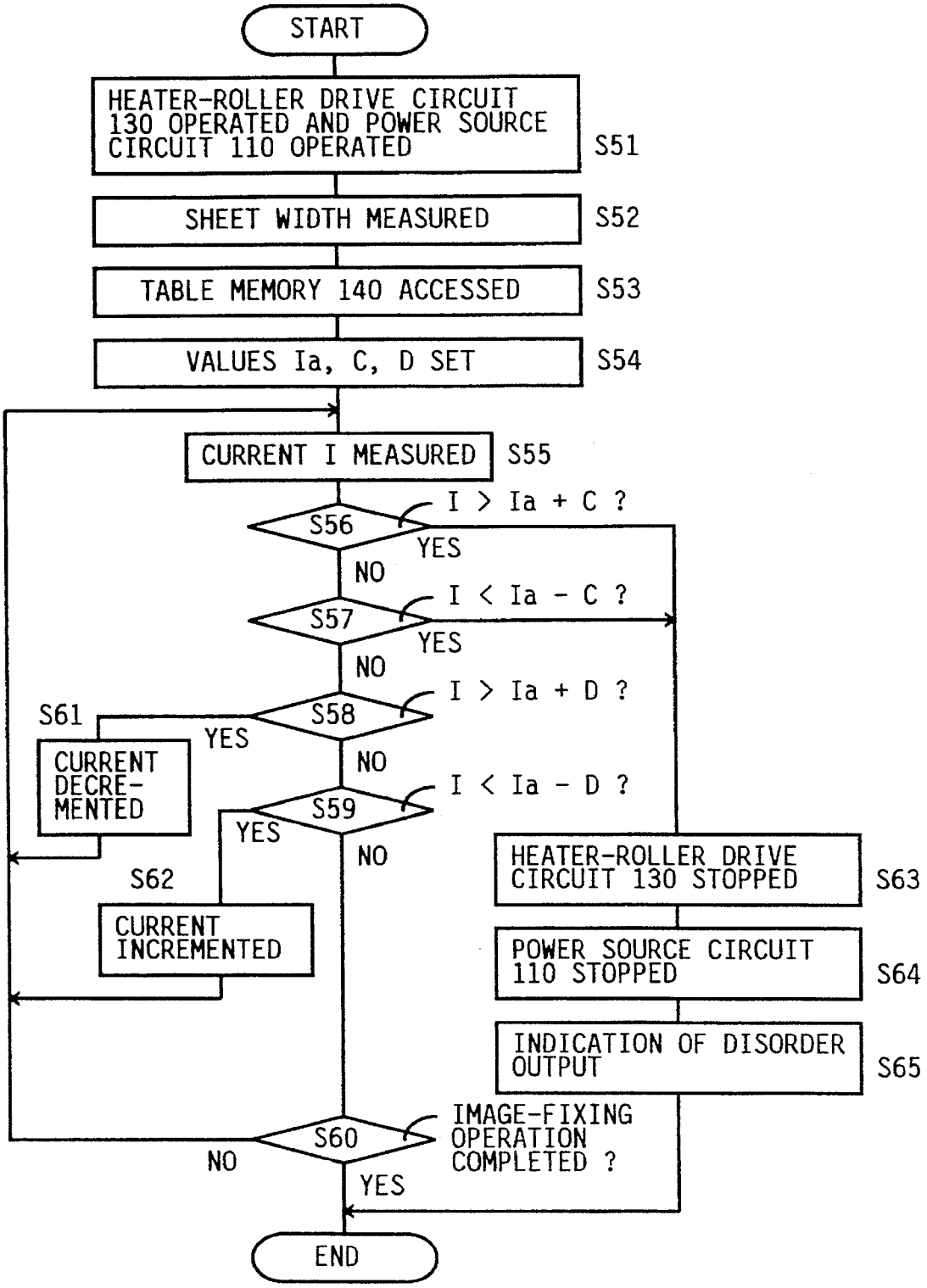
FIG. 10 is a flow chart according to which another image-fixing apparatus as a second embodiment of the invention is operated.

Next, there will be described a second embodiment of the present invention by reference to FIG. 10. The second embodiment also relates to a thermal image-fixing apparatus and has the same hardware construction as that shown in FIGS. 1–8, except that a table memory 140 stores a data table representing a relationship between (A) the B5, A4, B4, and A3 sizes of recording sheets 50 and (B) (b1) the corresponding center electric current values Ia, (b2) the corresponding permission half-width values C, and additionally (b3) corresponding control half-width values, D. The same reference numerals as used in FIGS. 1–8 for the first embodiment are used to designate the corresponding elements of the second embodiment. A control device 120 of the image-fixing apparatus in accordance with the second embodiment carries out a control program represented by the flow chart of FIG. 10, in place of the control program represented by the flow chart of FIG. 9 for the first embodiment.

First, the control device 120 or the CPU thereof carries out Step S51 that is the same as Step S11 of FIG. 9. Thus, the present apparatus 1 starts the thermal fixing of an unfixed toner image 51 on a recording sheet 50.

Step S52 is the same as Step S12 of FIG. 9. Step S53 is almost the same as Step S13 of FIG. 9, and the former is different from the latter in that the CPU selects, from the table memory 140, a control half-width value D in addition to the center current value Ia and the permission half-width value C, each corresponding to the size (e.g., B4) of the recording sheet 50 identified at Step S52. If other sheet sizes are identified, the CPU selects, from the table memory 140, the appropriate values Ia, C, D corresponding to each identified sheet size. At the following Step S54, the CPU sets the selected values Ia, C, D as control values used to control the electric current supplied to a heater roll 30. Step S55 is the same as Step S15 of FIG. 9. Each of the control half-width values D is a positive value smaller than a corresponding positive permission half-width value C.

Since Steps S56 and S57 are the same as Steps S16 and S17 of FIG. 9, respectively, the repeated description of those steps is omitted. If an electric current I measured at Step S55 falls within a permission range having an upper limit value, Ia+C, obtained by adding the permission half-width value C to the center current value Ia and a lower limit value, Ia–C, obtained by subtracting the permission half-width value C from the center current value Ia, there is no need to adjust the electric current I. In this case, a negative judgment is made at each of Steps S56 and S57, and the control of the CPU goes to Step S58, because a control range from Ia–D to Ia+D entirely falls within the permission range from Ia–C to Ia+C. At Step S58, the CPU judges whether the measured current I is excessively great and should be adjusted, i.e., the electric current I is greater than the upper limit value Ia+D obtained by adding the control half-width value D to the center current value Ia. If a negative judgment is made at Step S58, the control of the CPU goes to Step S59. At Step S59, the CPU judges whether the measured current I is excessively small and should be adjusted, i.e., the electric current I is smaller than the lower limit value Ia–D obtained by subtracting the control half-width value D from the center current value Ia. In the case where the electric current I falls within the control range of Ia±D, a negative judgment is made at each of Steps S58 and S59, and the control of the CPU goes to Step S60 that is the same as Step S18 of FIG. 9. Thus, if the judgments made at Steps S56 to S59 identify that the measured current I falls within the permission range of Ia±C and simultaneously within the control range of Ia±D, the CPU does not adjust the electric current I and the control thereof proceeds with Step S60. If a negative judgment is made at Step S60, that is, if an image-fixing operation has not been completed on the recording sheet 50, the control of the CPU goes back to Step S55 and the following steps. Meanwhile, if a positive judgment is made at Step S60, that is, if the image-fixing operation has been completed on the sheet 50, the current control cycle according to the flow chart of FIG. 10 is ended.

The measured current I does not fall within the permission range of Ia±C if, for example, the effective area of the nipper A defined by respective contact or deformed areas of the heater and presser rollers 30, 40 largely increases because of the jamming of the recording sheet 50 and an excessively great current flows through the heater roller 30. In this case, the electric current I exceeds the upper limit value Ia+C of the permission range of Ia±C, and a positive judgment is made at Step S56. Subsequently, the control of the CPU goes to Steps S63, S64 and S65 that are the same as Steps S19, S20, and S21 of FIG. 9. Also, the measured current I does not fall within the permission range of Ia±C if, for example, no electric current is supplied to the heater roller 30 because of some disorder of the present apparatus 1. In the last case, the electric current I is smaller than the lower limit value Ia–C of the permission range of Ia±C, and a positive judgment is made at Step S57. Then, the control of the CPU goes to Steps S63, S64 and S65.

In the case where the measured current I falls within the permission range of Ia±C but does not fall within the control range of Ia±D, for example, in the event that the measured current I is smaller than the upper limit Ia+C of the permission range but is greater than the upper limit Ia+D of the control range while an image-fixing operation is carried out on a thick recording sheet 50, a positive judgment is made at Step S58 and the control of the CPU goes to Step S61. At Step S61, the CPU supplies a control signal to the power source circuit 110 so as to decrease the electric current I by a predetermined small unit amount or decrement and thereby adjust the current I. Then, the control of the CPU returns to Step S55 and the following steps. On the other hand, in the event that the measured current I is greater than the lower limit Ia–C of the permission range but is smaller than the lower limit Ia–D of the control range while an image-fixing operation is carried out on a thin recording sheet 50, a positive judgment is made at Step S59 and the control of the CPU goes to Step S62. At Step S62, the CPU supplies a control signal to the power source circuit 110 so as to increase the electric current I by a predetermined small unit amount or increment and thereby adjust the current I. Then, the control of the CPU returns to Step S55 and the following steps.

In the second embodiment described above by reference to the flow chart of FIG. 10, the control device 120 or the CPU controls or adjusts the electric current I so as to keep it within the control range of Ia±D, even if the effective area of the nipper A changes depending on the recording sheets 50 of different thickness values. Consequently toner images 51 are fixed with appropriate amounts of thermal energy on the thickness-different recording sheets 50. In addition, even if recording sheets 50 of different width values are used, the control device 120 adjusts the electric current I based on the control values (i.e., center current value Ia, permission half-width value C, control half-width value D) appropriate for the width (i.e., size) of each recording sheet 50. Thus, an excellent fixation of the toner image 51 is effected on each recording sheet 50.

In the first and second embodiments in accordance with the present invention, the thermal energy produced at a portion of the resistant layer 35 corresponding to the nipper A is conducted to the recording sheet 50 via respective portions of the outer electrode layer 36 and the protection layer 37 each corresponding to the nipper A. Thus, at only the nipper A, the thermal energy conducted to the outer surface of the heater roller 30 is used to thermally fuse the toner image 51 on the recording sheet 50. The thermal fixation of the toner image 51 on the sheet 50 is effected with high quality while the sheet 50 is fed forward at high speed.

Since the thermal energy generated in the "nipper" portion of the resistant layer 35 is conducted to the recording sheet 50 via the thin "nipper" portions of the outer layers 36, 37, the conduction of the thermal energy enjoys high efficiency. Therefore, the heater roller 30 is very quickly placed in an image-fixing state in which the roller 30 can start an image-fixing operation on a recording sheet 50. Thus, the waiting or building-up time needed to start the image-fixing operation is minimized. Since the generation and conduction of the thermal energy are limited to respective portions of the heater and presser rollers 30, 40 corresponding to the nipper A, the other elements of the image-fixing apparatus 1 are effectively prevented from adversely being affected by the heat generated from the heater roller 30. In addition, the amount of electric power consumed by the present apparatus 1 is largely reduced. Moreover, the present image-fixing apparatus 1 is provided as a compact and reliable one.

Furthermore, since the image-fixing apparatus 1 has different permission ranges for different width values of recording sheets 50, the apparatus 1 quickly detects the jamming of any recording sheet 50, and stops the supplying of electric power to the heater roller 30, thereby preventing the apparatus 1 from being broken because of excessively raised temperatures. Even if the effective area of the nipper A changes depending upon the different thickness values of recording sheets 50 of a same width, the apparatus 1 automatically adjusts the supplied electric power so as to maintain it within the control range appropriate for that width. Consequently the toner images 51 are fixed on the recording sheets 50 of different thickness values with appropriate amounts of thermal energy. Moreover, even if recording sheets 50 of different width values are used, the apparatus 1 adjusts the supplied electric power to maintain it within the control range appropriate for each of the different width values. Thus, the thermal fixation of the toner image 51 on each recording sheet 50 is effected with high quality.

Figure 11:
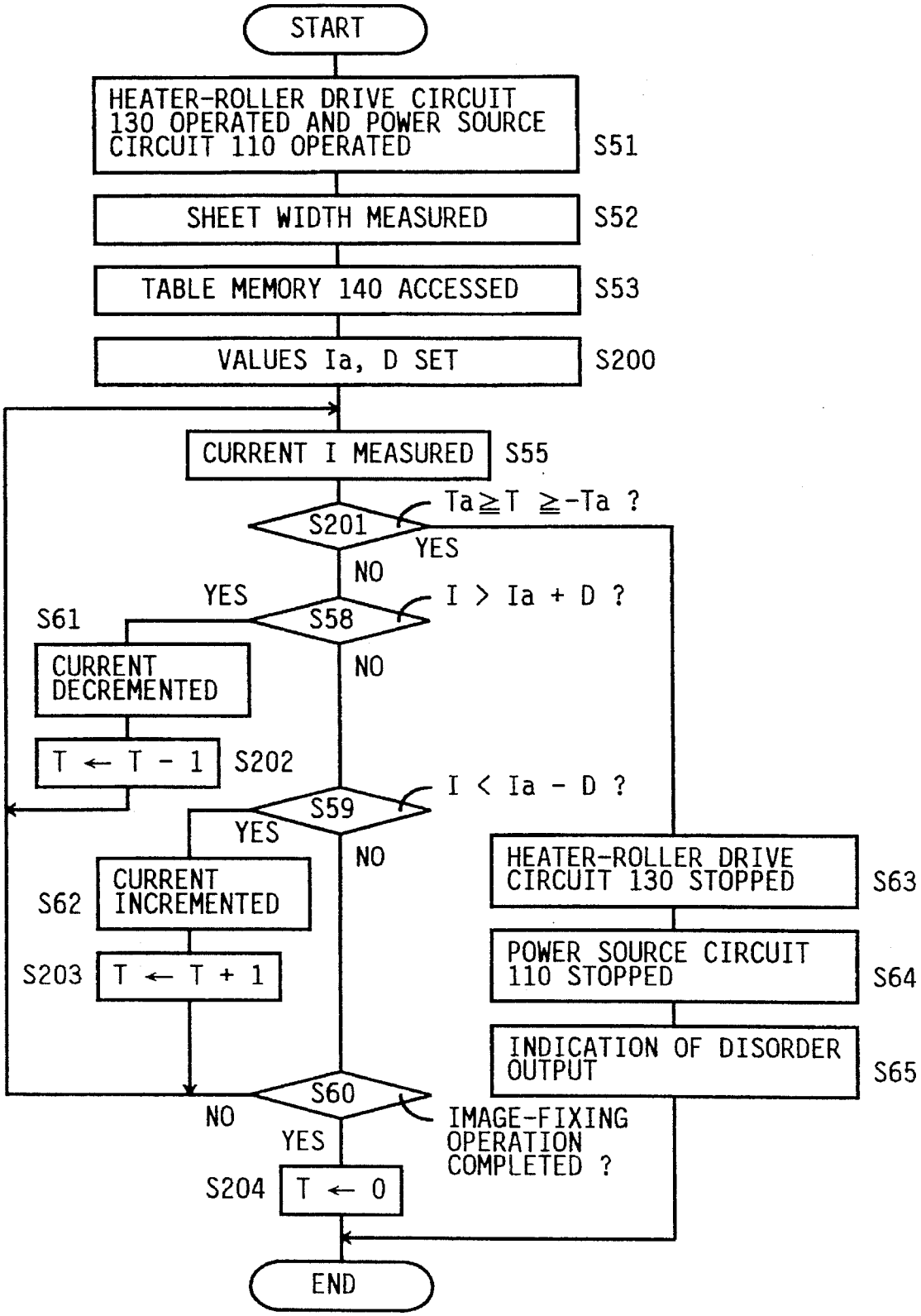
FIG. 11 is a flow chart corresponding to FIG. 10, according to which another image-fixing apparatus as a third embodiment of the invention is operated.

Referring further to FIG. 11, there is shown a flow chart representing a control program employed by a third embodiment of the present invention. The third embodiment has the same hardware construction as that of the first embodiment shown in FIGS. 1–8, except that a table memory 140 stores a data table representing a relationship between (A) the B5, A4, B4, and A3 sizes of recording sheets 50 and (B) (b1) the corresponding center current values Ia and (b2) the corresponding control half-widths D. In the flow chart of FIG. 11, the same steps as the steps employed in the flow chart of FIG. 10 are given the same reference numerals and the description of those steps is omitted.

At Step S200 following Step S53, a CPU of a 5 control circuit 120 of the present image-fixing apparatus sets the center current value Ia and the control half-width value D each corresponding to the size of a recording sheet 50 identified at Step S52, as control values with which the CPU controls a power source circuit 110. After the CPU reads in an electric current I supplied from the power source circuit 110 to a heater roller 30, through an electric-current measuring circuit 100, at Step S55, the control of the CPU goes to Step S201 to judge whether a content, T, of a counter falls within a "counter" permission range from –Ta to Ta (Ta >0). If a negative judgment is made at Step S201, the control goes to Steps S63 and the following steps.

On the other hand, if a positive judgment is made at Step S201, the control of the CPU goes to Step S58. If a positive judgment is made at Step S58, the control goes to Step S61 to decrement the electric current I by a small unit amount, and subsequently to Step S202 to subtract one from the content T of the counter. Then, the control of the CPU goes back to Step S55 and the following steps. Meanwhile, if a negative judgment is made at Step S58, the control goes to Step S59. If a positive judgment is made at Step S59, the control goes to Step S62 to increment the electric current I by a small unit amount, and subsequently to Step S203 to add one to the content T of the counter. Then, the control of the CPU goes back to Step S55 and the following steps. Meanwhile, if a negative judgment is made at Step S59, the control goes to Step S60, and subsequently to Step S204 to reset the content T of the counter to zero (T=0).

The content T of the counter represents the difference of the increased and decreased amounts of the electric current I during the image-fixing operation on the recording sheet 50. If the content T exceeds the upper limit Ta of the "counter" permission range, it indicates the occurrence of jamming of the recording sheet 50 at a nipper A provided by the heater roller 30 and a presser roller 40. The upper limit Ta is pre-determined such that the content T of the counter does not exceed the upper limit Ta so long as the recording sheet 50 is fed forward normally, i.e., without jamming. The current content T of the counter represents an electric current which is taken as a result of carrying out of Steps S61 and S62, and the initial value T=0 of the counter represents an electric current which would otherwise be taken without carrying out of Steps S61 and S62.

Figure 12:
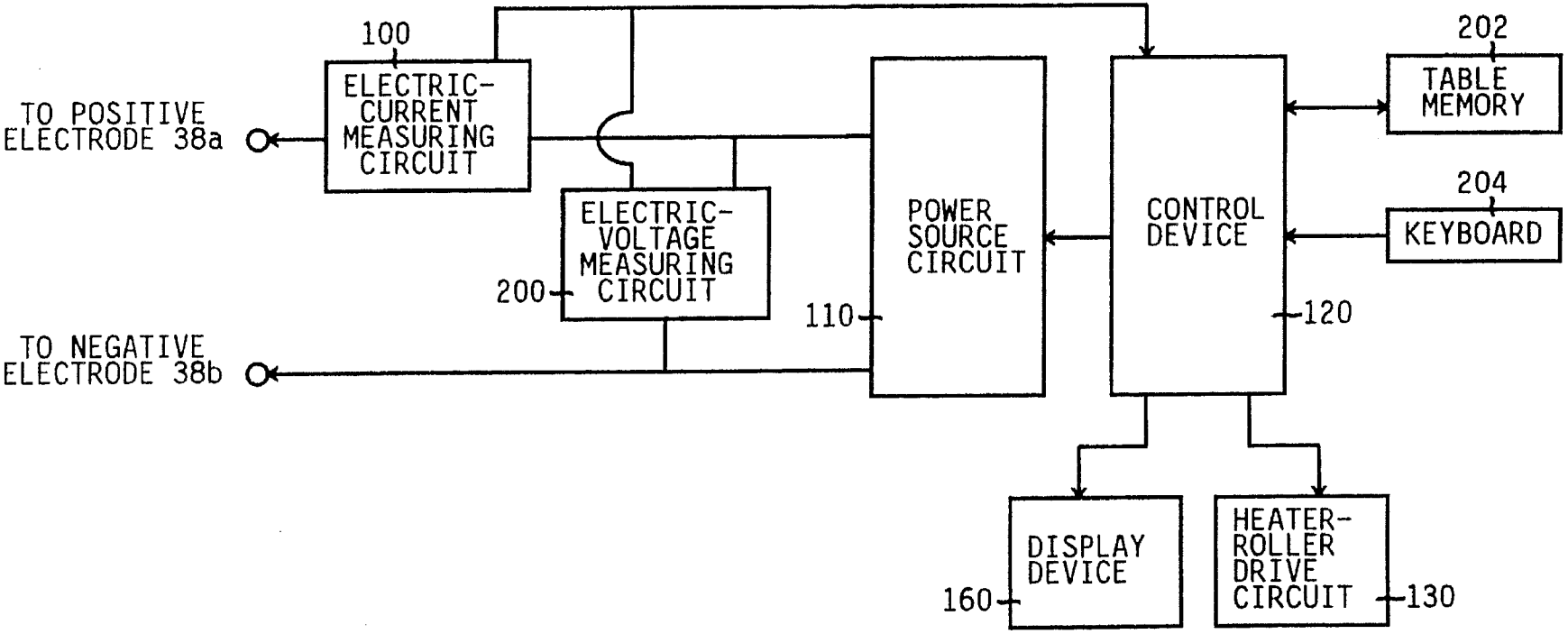
FIG. 12 is a diagrammatic view of the electric circuit of another image-fixing apparatus as a fourth embodiment of the invention.
Figure 13:
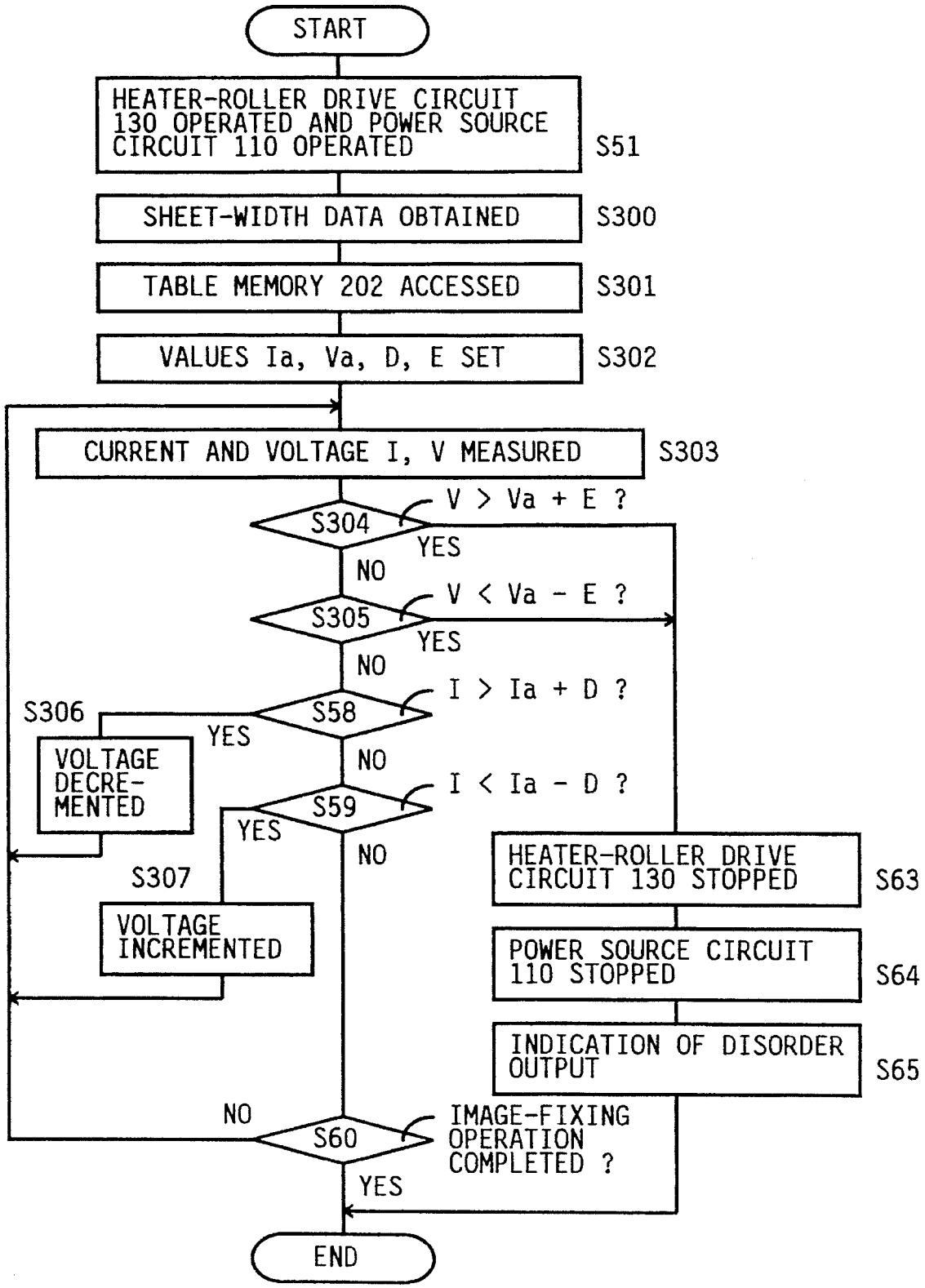
FIG. 13 is a flow chart corresponding to FIG. 10, according to which the image-fixing apparatus of FIG. 12 is operated.

Referring further to FIGS. 12 and 13, there is shown a fourth embodiment of the invention also relating to a thermal image-fixing apparatus. The present apparatus is different from the apparatus shown in FIGS. 1–8, in that the former additionally has an electric-voltage measuring circuit 200, and has a table memory 202 in place of the table memory 140 of the latter, and a keyboard 204 in place of the optical sensors 80*a* to 80*d* and sensor circuit 150 of the latter. The electric-voltage measuring circuit 200 measures an electric voltage of an electric power or electricity supplied to a heater roller 30. The table memory 202 stores a data table representing a relationship between (A) the B5, A4, B4 and A3 sizes of recording sheets 50 and (B) (b1) the corresponding center current values Ia and (b2) corresponding control current half-widths D, and additionally (b3) the corresponding center voltage values, Va, and (b4) corresponding permission voltage half-widths, E. The keyboard 204 is operable by a user for inputting sheet data representing the B5, A4, B4, or A3 size of the recording sheet 50. In the flow chart of FIG. 13, the same steps as the steps used in the flow chart of FIG. 10 are given the same reference numerals and the description of those steps is omitted.

At Step S300 following Step S51, a CPU of a control circuit 120 of the present image-fixing apparatus reads in the sheet data input through the keyboard 204 and stored in a RAM of the control circuit 120. Step S300 is followed by Step S301 to select the center current value Ia, control current half-width value D, center voltage value Va, and permission voltage half-width value E each corresponding to the size of the recording sheet 50 specified at Step S300, as control values with which the CPU controls a power source circuit 110. After the CPU reads in an electric current I and an electric voltage V supplied to a heater roller 30, through an electric-current measuring circuit 100 and the electric-voltage measuring circuit 200, at Step S303, the control of the CPU goes to Step S304 to judge whether the measured electric voltage V is greater than an upper limit value obtained by adding the permission voltage half-width value E to the center voltage value Va. If a negative judgment is made at Step S304, that is, if the measured voltage V is not greater than the upper limit Va+E, the control of the CPU goes to Step S305. At Step S305, the CPU judges whether the measured voltage V is smaller than a lower limit value obtained by subtracting the permission voltage half-width value E from the center voltage value Va. If a negative judgment is made at Step S305, that is, if the measured voltage V is greater than the lower limit Va–E, the control of the CPU goes to Step S58. On the other hand, if a positive judgment is made at Step S304 or S305, the control goes to Steps S63 and the following steps.

If a positive judgment is made at Step S58, the control goes to Step S306 to decrement the electric voltage V by a small unit amount. Then, the control of the CPU goes back to Step S303 and the following steps. Meanwhile, if a negative judgment is made at Step S58, the control goes to Step S59. If a positive judgment is made at Step S59, the control goes to Step S307 to increment the electric voltage V by a small unit amount. Then, the control of the CPU goes back to Step S303 and the following steps. Meanwhile, if a negative judgment is made at Step S59, the control goes to Step S60.

The measured voltage V contains the control amounts increased and/or decreased from the initial center voltage Va to maintain the electric current I within the control range of Ia±D during the image-fixing operation effected on the recording sheet 50. If the measured voltage V exceeds the upper limit Va+E of the permission voltage range, it indicates the occurrence of jamming of the recording sheet 50 at a nipper A provided by the heater roller 30 and a presser roller 40. The center value Va and permission half-width value E are pre-determined such that the measured voltage V does not exceed the upper limit Va+E so long as the recording sheet 50 is fed forward normally without jamming. The measured voltage V represents an electric voltage which is taken as a result of carrying out of Steps S306 and S307, and the initial center voltage Va represents an electric current which would otherwise be taken without carrying out of Steps S306 and S307.

While the present invention has been described in its preferred embodiments, the present invention may otherwise be embodied.

For example, while in the illustrated embodiments the width of the recording sheet 50 is measured by the sheet-width sensors 80*a* to 80*d*, it is possible to employ other types of sensors such as a sensor which identifies different sizes of recording-sheet cartridges each adapted to be inserted in a copying machine.

Additionally, although in the second and third embodiments the amount of electricity supplied to the heater roller 30 is monitored by measuring the electric current I and is controlled by adjusting the electric current I, it is possible to monitor an electric voltage supplied to the heater roller 30 and adjusts the electric voltage based on a permission voltage range and/or a control voltage range.

While in the first to third embodiments the optical sensors 80*a* to 80*d* are used to measure the width of the recording sheet 50, it is possible to employ a sensor which measures the thickness of the recording sheet 50, a sensor which measures the surface roughness of the recording sheet 50, and/or a sensor which measures the moisture content of the recording sheet 50, in place of or in addition to the sheet-width sensors 80*a*–80*d*. The sheet-thickness sensor may be of a type which includes an actuator adapted to engage the upper surface of the sheet 50 and displace depending upon the level of the upper surface of the same 50, and an amplifier enlarging the displacement of the actuator. The sheet-roughness sensor is located in the path of feeding of the recording sheet 50. Since the air occurring in a rough surface of the sheet 50 functions as a heat insulator, the rough sheet 50 suffers low thermal conductivity. Thus, the surface roughness of the sheet 50 influences the amount of thermal energy needed to thermally fix the toner image 51 on the sheet 50. The sheet-moisture sensor may be of a type which includes two electrodes for measuring an electric conductivity of the recording sheet 50. Since the electric conductivity has high correlation with the moisture content, the moisture content of the sheet 50 may be obtained by measuring the electric conductivity of the sheet 50. Those electrodes may be embedded in a sheet feeding roller. When a more amount of thermal energy is applied to the sheet 50 having a high water content, the degree of curling of the output sheet increases. In these cases, the table memory 140, 202 may store a data table representing a relationship between the different values of thickness, surface roughness, or moisture content of recording sheets 50 and the corresponding values Ia, C, and/or D.

In the illustrated embodiments, the table memory 140, 202 may be modified to store a mathematical function defining a relationship between the values of widths (sizes), thickness, surface roughness, or moisture content of recording sheets 50 and the corresponding values Ia, Va, C, D, and/or E.

In the fourth embodiment, the keyboard 204 may be modified to input sheet dimension or parameter data representing the thickness, surface roughness, or moisture content of the recording sheet 50, in place of or in addition to the width (size) of the same 50.

In the fourth embodiment, Steps S58 and S59 may be replaced by a step in which the CPU judges whether a measured electric power or electricity, W, is greater than the upper limit of a "electricity" permission range of Wa±F, and a subsequent step in which the CPU judges whether the measured electricity W is smaller than the lower limit of the permission range of Wa±F. The measured electricity W is obtained as the product of the measured current value I and measured voltage value V.

It is to be understood that the present invention may be embodied with other changes, improvements, and modifications that may occur to those skilled in the art without departing from the spirit and scope of the invention defined in the appended claims.

What is claimed is:

1. An image-fixing apparatus comprising:

a presser roller which is rotatable about a first rotation axis thereof;

a heater roller which is rotatable about a second rotation axis thereof parallel to said first rotation axis and which is held in contact with said presser roller to provide a nipper for nipping a recording sheet bearing an unfixed image thereon, an electric resistance of said heater roller decreasing as respective contact areas of said heater and presser rollers which areas define said nipper increase because of elastic deformation of the heater roller;

a supplying device which supplies an electricity to said heater roller so that said nipper generates a thermal energy to thermally fix said unfixed image on said recording sheet;

a measuring device which measures said electricity supplied from said supplying device to said heater roller;

a sheet-data obtaining device which obtains sheet data representing at least one of a width and a thickness of said recording sheet;

a memory in which is stored a relationship between said at least one of said width and said thickness of said recording sheet and a permission range regarding said electricity; and a control device which stops the supplying of said electricity from said supplying device to said heater roller, when said electricity measured by said measuring device does not fall within said permission range corresponding to said at least one of said width and said thickness of said recording sheet represented by said sheet data obtained by said sheet-data obtaining device.

2. An image-fixing apparatus according to claim 1, wherein said heater roller comprises:

(a) a cylindrical resilient layer which is formed of an electrically insulating and resilient material, is concentric with said second rotation axis, and has a plurality of through holes formed through a thickness thereof;

(b) a first cylindrical electrode layer which is concentric with said second rotation axis and has a plurality of electrodes each of which extends into a corresponding one of said through holes of said resilient layer;

(c) a cylindrical resistant layer concentric with said second rotation axis, said resistant layer and said first electrode layer sandwiching said resilient layer; and (d) a second cylindrical electrode layer concentric with said second rotation axis, said second electrode layer and said resilient layer sandwiching said resistant layer, a portion of said resilient layer corresponding to said nipper being resiliently deformable so that a portion of said first electrode layer corresponding to the nipper is held in electric contact via the electrodes thereof corresponding to the nipper with a portion of said resistant layer corresponding to the nipper, said supplying device supplying said electricity to said heater roller through said first and second electrode layers so that said portion of said resistant layer corresponding to said nipper generates said thermal energy to thermally fix said unfixed image on said recording sheet.

3. An image-fixing apparatus according to claim 1, wherein said sheet-data obtaining device comprises a sheet-dimension measuring device which measures, as said sheet data, said at least one of said width and said thickness of said recording sheet.

4. An image-fixing apparatus according to claim 1, wherein said sheet-data obtaining device comprises an input device which is operable for inputting said sheet data representing said at least one of said width and said thickness of said recording sheet.

5. An image-fixing apparatus according to claim 1, wherein said memory stores, as said relationship, a data table including a plurality of permission ranges corresponding to a plurality of values of said at least one of said width and said thickness of said recording sheet.

6. An image-fixing apparatus according to claim 5, wherein said control device comprises:

selecting means for selecting, from said data table stored in said memory, one of said permission ranges corresponding to said at least one of said width and said thickness of said recording sheet represented by said sheet data obtained by said sheet-data obtaining device; and stopping means for stopping said supplying of said electricity from said supplying device to said heater roller, when said electricity measured by said measuring device does not fall within the selected one permission range.

7. An image-fixing apparatus according to claim 1, further comprising an informing device which informs that said control device has stopped said supplying of said electricity from said supplying device to said heater roller.

8. An image-fixing apparatus according to claim 1, further comprising a driving device which rotates at least one of said heater and presser rollers to feed said recording sheet, said control device comprising means for controlling said driving device to stop the rotation of said at least one of said heater and presser rollers and thereby stop the feeding of said recording sheet, when said electricity measured by said measuring device does not fall within said permission range.

9. An image-fixing apparatus according to claim 1, wherein said control device comprises:

control means for controlling said supplying of said electricity from said supplying device to said heater roller, so that said electricity measured by said measuring device falls within a control range fully covered by said permission range; and stopping means for stopping said supplying of said electricity from said supplying device to said heater roller when the controlling of said control means regarding said supplying of said electricity is not effective in causing said electricity measured by said measuring device to remain within said control range and eventually the measured electricity has deviated from said permission range.

10. An image-fixing apparatus according to claim 1, wherein said measuring device measures at least one of an electric current and an electric voltage of said electricity supplied from said supplying device to said heater roller, said memory storing said relationship between said at least one of said width and said thickness of said recording sheet and said permission range regarding said at least one of said electric current and voltage of said electricity.

11. An image-fixing apparatus comprising:

a presser roller which is rotatable about a first rotation axis thereof;

a heater roller which is rotatable about a second rotation axis thereof parallel to said first rotation axis and which is held in contact with said presser roller to provide a nipper for nipping a recording sheet bearing an unfixed image thereon, an electric resistance of said heater roller decreasing as respective contact areas of said heater and presser rollers which areas define said nipper increase because of elastic deformation of the heater roller;

a supplying device which supplies a electricity to said heater roller so that said nipper generates a thermal energy to thermally fix said unfixed image on said recording sheet;

a measuring device which measures said electricity supplied from said supplying device to said heater roller;

a first sheet-data obtaining device which obtains first sheet data representing at least one thermal parameter of said recording sheet;

a first memory in which is stored a first relationship between said at least one thermal parameter of said recording sheet and a control range regarding said electricity; and a control device which controls the supplying of said electricity from said supplying device to said heater roller, so that said electricity measured by said measuring device falls within said control range corresponding to said at least one thermal parameter of said recording sheet represented by said first sheet data obtained by said first sheet-data obtaining device.

12. An image-fixing apparatus according to claim 11, wherein said heater roller comprises:

(a) a cylindrical resilient layer which is formed of an electrically insulating and resilient material, is concentric with said second rotation axis, and has a plurality of through holes formed through a thickness thereof;

(b) a first cylindrical electrode layer which is concentric with said second rotation axis and has a plurality of electrodes each of which extends into a corresponding one of said through holes of said resilient layer;

(c) a cylindrical resistant layer concentric with said second rotation axis, said resistant layer and said first electrode layer sandwiching said resilient layer; and (d) a second cylindrical electrode layer concentric with said second rotation axis, said second electrode layer and said resilient layer sandwiching said resistant layer, a portion of said resilient layer corresponding to said nipper being resiliently deformable so that a portion of said first electrode layer corresponding to the nipper is held in electric contact via the electrodes thereof corresponding to the nipper with a portion of said resistant layer corresponding to the nipper, said supplying device supplyimg said electricity to said heater roller through said first and second electrode layers so that said portion of said resistant layer corresponding to said nipper generates said thermal energy to thermally fix said unfixed image on said recording sheet.

13. An image-fixing apparatus according to claim 11, wherein said first sheet-data obtaining device comprises a sheet-parameter measuring device which measures, as said first sheet data, said at least one thermal parameter of said recording sheet.

14. An image-fixing apparatus according to claim 13, wherein said sheet-parameter measuring device measures, as said at least one thermal parameter of said recording sheet, at least one of a width, a thickness, a surface roughness, and a moisture content of said recording sheet.

15. An image-fixing apparatus according to claim 13, wherein said first sheet-data obtaining device comprises an input device which is operable for inputting said first sheet data representing said at least one thermal parameter of said recording sheet.

16. An image-fixing apparatus according to claim 11, wherein said first memory stores, as said first relationship, a first data table including a plurality of control ranges corresponding to a plurality of values of said at least one thermal parameter of said recording sheet.

17. An image-fixing apparatus according to claim 16, wherein said control device comprises:

first selecting means for selecting, from said first data table stored in said first memory, one of said control ranges corresponding to said at least one thermal parameter of said recording sheet represented by said first sheet data obtained by said first sheet-data obtaining device; and control means for controlling said supplying of said electricity from said supplying device to said heater roller, so that said electricity measured by said measuring device falls within the selected one control range.

18. An image-fixing apparatus according to claim 16, further comprising:

a second sheet-data obtaining device which obtains second sheet data representing at least one of a width and a thickness of said recording sheet; and a second memory in which is stored a second relationship between said at least one of said width and said thickness of said recording sheet and a permission range regarding said electricity.

19. An image-fixing apparatus according to claim 18, wherein said second memory stores, as said second relationship, a second data table including a plurality of permission ranges corresponding to a plurality of values of said at least one of said width and said thickness of said recording sheet.

20. An image-fixing apparatus according to claim 19, wherein said control device comprises:

second selecting means for selecting, from said second data table stored in said second memory, one of said permission ranges corresponding to said at least one of said width and said thickness of said recording sheet represented by said second sheet data obtained by said second sheet-data obtaining device; and stopping means for stopping said supplying of said electricity from said supplying device to said heater roller, when said electricity measured by said measuring device does not fall within the selected one permission range.

21. An image-fixing apparatus according to claim 11, wherein said control device comprises adjusting means for decreasing said electricity supplied from said supplying device to said heater roller, by a first unit amount, when said electricity measured by said measuring device is greater than an upper limit of said selected one control range, and increasing said electricity supplied from said supplying device to said heater roller, by a second unit amount, when said electricity measured by said measuring device is smaller than a lower limit of said selected one control range.

22. An image-fixing apparatus according to claim 11, wherein said control device comprises:

a control-amount data obtaining device which obtains control-amount data representing a difference of (a) a first value of said electricity which is taken as a result of operation of said control device and (b) a second value of said electricity which would otherwise be taken without said operation of said control device; and stopping means for stopping said supplying of said electricity from said supplying device to said heater roller when said difference between said first and second values of said electricity does not fall within a reference control-amount range.

23. An image-fixing apparatus according to claim 22, wherein said control device further comprises adjusting means for decreasing said electricity supplied from said supplying device to said heater roller, by a first amount, when said electricity measured by said measuring device is greater than an upper limit of said control range, and increasing said electricity supplied from said supplying device to said heater roller, by a second amount, when said electricity measured by said measuring device is smaller than a lower limit of said control range, said control-amount data obtaining device obtaining said control-amount data representing, as said difference, a difference of said first and second amounts, said stopping means stopping said supplying of said electricity from said supplying device to said heater roller when said difference of said first and second amounts does not fall within said reference control-amount range.

24. An image-fixing apparatus according to claim 23, wherein said measuring device measures at least one of an electric current and an electric voltage of said electricity supplied from said supplying device to said heater roller, said first memory storing said first relationship between said at least one parameter of said recording sheet and said control range regarding said at least one of said electric current and voltage of said electricity.

25. An image-fixing apparatus according to claim 22, wherein said control device further comprises adjusting means for decreasing one of an electric current and an electric voltage of said electricity supplied from said supplying device to said heater roller, by decreasing the other of said electric current and voltage by a first amount, when said electricity measured by said measuring device is greater than an upper limit of said control range, and increasing said one of the electric current and voltage by increasing said other of the electric current and voltage by a second amount, when said electricity measured by said measuring device is smaller than a lower limit of said control range, said control-amount data obtaining device obtaining said control-amount data representing, as said difference, a difference of said first and second amounts, said stopping means stopping said supplying of said electricity from said supplying device to said heater roller when said difference of said first and second amounts does not fall within said reference control-amount range.

26. An image-fixing apparatus according to claim 25, wherein said measuring device as a first measuring device measures said one of said electric current and voltage of said electricity supplied from said supplying device to said heater roller, said control-amount data obtaining device comprising a second measuring device which measures said other of said electric current and voltage of said electricity supplied from said supplying device to said heater roller, said first memory storing said first relationship between said at least one parameter of said recording sheet and said control range regarding said one of said electric current and voltage of said electricity.

27. An image-fixing apparatus comprising:

a presser roller which is rotatable about a first rotation axis thereof;

a heater roller which is rotatable about a second rotation axis thereof parallel to said first rotation axis and which is held in contact with said presser roller to provide a nipper for nipping a recording sheet bearing an unfixed image thereon, an electric resistance of said heater roller decreasing as respective contact areas of said heater and presser rollers which areas define said nipper increase;

a supplying device which supplies an electricity to said heater roller so that said nipper generates a thermal energy to thermally fix said unfixed image on said recording sheet;

a measuring device which measures said electricity supplied from said supplying device to said heater roller; and a sheet-jamming detecting device which detects a jamming of said recording sheet at said nipper, based on said electricity measured by said measuring device.

28. An image-fixing apparatus according to claim 27, said sheet-jamming detecting device comprises means for identifying that said jamming of said recording sheet has occurred, when said electricity measured by said measuring device does not fall within a reference range.

29. An image-fixing apparatus according to claim 27, said sheet-jamming detecting device comprises means for identifying that said jamming of said recording sheet has occurred, when a rate of change of said electricity measured by said measuring device does not fall within a reference range.

30. An image-fixing apparatus according to claim 27, further comprising an informing device which informs that said sheet-jamming detecting device has detected said jamming of said recording sheet.

31. An image-fixing apparatus according to claim 27, further comprising a control device which stops the supplying of said electricity from said supplying device to said heater roller, when said sheet-jamming detecting device has detected said jamming of said recording sheet.

* * * * *